US007421999B2

(12) United States Patent
Kim et al.

(10) Patent No.: US 7,421,999 B2
(45) Date of Patent: Sep. 9, 2008

(54) CONTROL APPARATUS FOR AN INTERNAL COMBUSTION ENGINE CAPABLE OF PRE-MIXED CHARGE COMPRESSION IGNITION

(75) Inventors: Kyoung-Oh Kim, Susono (JP); Tatsuo Kobayashi, Susono (JP); Masato Kubota, Susono (JP); Yasushi Noguchi, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/594,965

(22) PCT Filed: Mar. 30, 2005

(86) PCT No.: PCT/JP2005/006693

§ 371 (c)(1),
(2), (4) Date: Jun. 25, 2007

(87) PCT Pub. No.: WO2005/095768

PCT Pub. Date: Oct. 13, 2005

(65) Prior Publication Data

US 2008/0000445 A1 Jan. 3, 2008

(30) Foreign Application Priority Data

Mar. 30, 2004 (JP) ..... 2004-101547

(51) Int. Cl.
*F02B 47/00* (2006.01)

(52) U.S. Cl. ..... 123/295; 123/304; 123/305; 123/25 C

(58) Field of Classification Search ..... 123/295, 123/304, 305, 25 C
See application file for complete search history.

(56) References Cited

U.S. PATENT DOCUMENTS 5,832,880 A * 11/1998 Dickey ..... 123/25 C (Continued)

FOREIGN PATENT DOCUMENTS

JP A 11-101127 4/1999

(Continued)

OTHER PUBLICATIONS

Jari Hyvonen et al., "Supercharging HCCI to Extend the Operating Range in a Multi-Cylinder VCR-HCCI Engine," SAE International, Oct. 27, 2003 (No. 2003-01-3214).

(Continued)

*Primary Examiner*—Erick Solis
(74) *Attorney, Agent, or Firm*—Oliff & Berridge, PLC

(57) ABSTRACT

An electric control device 70 is applied to an internal combustion engine 10 capable of a pre-mixed charge compression ignition combustion in which air-fuel mixture gas including air and fuel injected from an injector 37 is formed in a combustion chamber 25, and the air-fuel mixture gas is self-ignited to be combusted by compressing the air-fuel mixture gas during a compression stroke. The electric control device injects high pressure fluid such as air from the air injection valve 38 into the air-fuel mixture gas at a predetermined acting timing within a compression stroke prior to fuel pyrolysis starting timing to enhance the temperature un-uniformity of the air-fuel mixture gas. This enables the temperature un-uniformity of the air-fuel mixture gas at the fuel pyrolysis starting timing to become larger than the temperature un-uniformity of the air-fuel mixture gas at the fuel pyrolysis starting timing obtained only by simply compressing the air-fuel mixture gas during the compression stroke. As a result, the combustion is moderated and the combustion noise is reduced.

25 Claims, 17 Drawing Sheets

U.S. PATENT DOCUMENTS

| | | | | |
|---|---|---|---|---|
| 6,640,754 | B1 * | 11/2003 | Iida | 123/27 R |
| 7,036,482 | B2 * | 5/2006 | Beck et al. | 123/229 |
| 7,270,108 | B2 * | 9/2007 | Lemke | 123/299 |

FOREIGN PATENT DOCUMENTS

| | | |
|---|---|---|
| JP | A 2000-97032 | 4/2000 |
| JP | A 2001-159349 | 6/2001 |
| JP | A 2001-164979 | 6/2001 |
| JP | A 2001-214741 | 8/2001 |
| JP | A 2001-254660 | 9/2001 |
| JP | A 2001-263067 | 9/2001 |
| JP | A 2001-303956 | 10/2001 |
| JP | A 2002-38955 | 2/2002 |
| JP | A 2002-188447 | 7/2002 |
| JP | A 2002-195040 | 7/2002 |
| JP | A 2002-357138 | 12/2002 |
| JP | A 2003-49650 | 2/2003 |
| JP | A 2004-3428 | 1/2004 |

OTHER PUBLICATIONS

Nigel F. Gale et al., "HCCI Combustion Control in a Multi-Cylinder Engine Through Dual Fuel Operation," JSAE Spring Convention Proceedings, No. 64-01, pp. 1-4, May 23, 2001.

A. Groenendijk et al., "Mixture Formation and Combustion Control for Low Emission DI Diesel Combustion with HCCI-Characteristics," THIESEL 2002 Conference on Thermo- and Fluid-Dynamic Processes in Diesel Engines, pp. 145-158, Sep. 10, 2002.

Tanet Aroonsrisopon et al., "Comparison of HCCI Operating Ranges for Combinations of Intake Temperature, Engine Speed and Fuel Composition," Society of Automotive Engineers, Jun. 3, 2002 (No. 2002-01-1924).

Ryuichi Tominaga et al., "Effects of Heterogeneous EGR on the Natural Gas Fueled HCCI Engine Using Experiments, CFD and Detailed Kinetics," SAE International, Mar. 8, 2004 (No. 2004-01-0945).

Toshio Shudo et al., "HCCI Combustion of Hydrogen, Carbon Monoxide and Dimethyl Ether," Society of Automotive Engineers, Inc., Mar. 4, 2002 (No. 2002-01-0112).

Tomonori Urushihara et al., "Expansion of HCCI Operating Region by the Combination of Direct Fuel Injection, Negative Valve Overlap and Internal Fuel Reformation," SAE International, Mar. 3, 2003 (No. 2003-01-0749).

* cited by examiner

CONTROL APPARATUS FOR AN INTERNAL COMBUSTION ENGINE CAPABLE OF PRE-MIXED CHARGE COMPRESSION IGNITION

FIELD OF THE INVENTION

The present invention relates to a control apparatus for an internal combustion engine suitable for a pre-mixed (or homogeneous) charge compression ignition combustion, in which air-fuel mixture gas including at least air and fuel is formed in a combustion chamber and the air-fuel mixture is self-ignited (or ignited spontaneously) to be combusted (or burned) by compressing the air-fuel mixture gas during a compression stroke.

BACKGROUND OF THE INVENTION

A pre-mixed charge compression ignition combustion engine has been known, in which air-fuel mixture gas including air and fuel is formed in a combustion chamber and the air-fuel mixture is self-ignited to be combusted (burned) by compressing the air-fuel mixture during a compression stroke. In the pre-mixed charge compression ignition engine, an air-fuel ratio (a ratio of air to fuel) can be extremely large (lean) and a high compression ratio can be adopted. Therefore, fuel consumption may be improved and an amount of NOx may be decreased, if the engine is operated (or driven) by pre-mixed charge compression ignition combustion in a wider driving area.

In the self-ignition combustion, the compressed air-fuel mixture is self-ignited substantially simultaneously at multiple ignition points and the combustion takes place (or lasts) in an extremely short period. This causes noise to be large, especially under a high load driving condition where an amount of fuel is large, because a pressure in the combustion chamber (or a chamber pressure) increases rapidly. The reason why the pre-mixed charge compression ignition combustion can not be used under the high load driving condition is that such noise becomes excessively large.

Meanwhile, if the self-ignition combustion can be made to proceed moderately (relatively slowly), it is possible to reduce such combustion noise since a rising rate (or an increasing ratio) in the chamber pressure decreases. With this view, in a conventional pre-mixed charge compression ignition engine, an area (where EGR gas layer and air layer have in contact with each other) where a temperature gradient is large is formed in the combustion chamber by introducing through one of two intake ports high temperature gas (or the EGR gas) which has been displaced from the combustion chamber and by introducing through the other intake ports low temperature air during an intake stroke, and then fuel is injected into the area. It is inferred that this enables the self-ignition combustion to proceed from the higher temperature area to the lower temperature area according to the temperature gradient, and therefore, suppressing the rapid combustion can be achieved (see Japanese Patent Application Laid-Open (kokai) No. 2001-214741, claim 1, paragraphs 0028-0029, 0044-0049, FIGS. 4, 5, and 26(*a*)).

However, according to various examinations, the inventors have found that the temperature gradient (or spatial temperature un-uniformity ("un-unifromity" means "inhomogeneity" in this application) of the air-fuel mixture) which has been formed in the combustion chamber prior to the compression stroke decreases (or substantially disappears) during an early part of the compression stroke. Thus, in the conventional pre-mixed charge compression ignition combustion engine, the appropriate temperature un-uniformity of the mixture gas in the combustion chamber can not exist when a reaction relating to the self-ignition starts in the vicinity of a top dead center at the end of the compression stroke. As a result, there is a problem that it is not possible to moderate the combustion appropriately.

SUMMARY OF THE INVENTION

One of objects of the present invention is to provide a control apparatus for an internal combustion engine capable of moderating self-ignition combustion by making temperature un-uniformity of air-fuel mixture gas at a fuel pyrolysis starting timing larger than temperature un-uniformity of air-fuel mixture gas at the fuel pyrolysis starting timing which is obtained by simply compressing the air-fuel mixture gas during the compression stroke.

A control apparatus for an internal combustion engine of the present invention is applied to the engine capable of a pre-mixed charge compression ignition combustion. The engine has fuel injection means for injecting fuel into a combustion chamber defined by a cylinder and a piston. In the engine, when a driving condition of the engine is within a self-ignition area which is at least a part of whole driving area, air-fuel mixture gas including at least air and fuel injected by the fuel injection means is formed in the combustion chamber and the air-fuel mixture gas is self-ignited to be combusted (burned) by compressing the air-fuel mixture gas during a compression stroke.

The control apparatus comprises temperature un-uniformity adding means (temperature inhomogeneity adding (supplementarily providing means)) for acting on the air-fuel mixture gas so as to enhance temperature un-uniformity (or un-uniformity of temperature) of the air-fuel mixture gas at a predetermined acting timing which is within a compression stroke prior to fuel pyrolysis starting timing which takes place during the compression stroke in such a manner that the temperature un-uniformity of the air-fuel mixture gas at the fuel pyrolysis starting timing is made larger than temperature un-uniformity of the air-fuel mixture gas at the fuel pyrolysis starting timing, the latter temperature un-uniformity being obtained only by simply compressing the air-fuel mixture gas during the compression stroke.

By the control apparatus described above, the temperature un-uniformity of the air-fuel mixture gas is enhanced (or is made larger, greater or increased) at the predetermined acting timing within a compression stroke prior to the fuel pyrolysis starting timing. As a result, the temperature un-uniformity of the air-fuel mixture gas at the fuel pyrolysis starting timing which occurs just before the self-ignition timing is made larger than temperature un-uniformity of the same normally obtained only by simply compressing the air-fuel mixture gas during the compression stroke. Meanwhile, combustion reaction speed strongly depends on temperature of the air-fuel mixture gas. Thus, the self-ignition combustion can be moderated and the combustion period can be lengthen (be made longer) because the combustion reaction speed becomes unequal (or un-uniformed) between high temperature area and low temperature area. As a result, it is avoided that the pressure rising rate becomes excessive, and therefore, the combustion noise is reduced.

In the case above, it is preferable that the temperature un-uniformity adding means be configured so as to inject high pressure fluid into the air-fuel mixture gas at said predetermined acting timing to enhance the temperature un-uniformity of the air-fuel mixture gas.

By this feature, because the high pressure fluid is injected into the air-fuel mixture gas in the combustion chamber whose pressure is lower than the injected fluid, the temperature of the injected fluid decreases due to the effect of the adiabatic expansion. As a result, it is possible to provide the air-fuel mixture gas with the temperature un-uniformity more effectively.

In the case above, it is also preferable that the temperature un-uniformity adding means be configured so as to inject said high pressure fluid only when a driving condition of the internal combustion engine is within the self-ignition area and a load of the internal combustion engine is larger than a predetermined high load threshold.

By this feature, the high pressure fluid is injected, for instance, only when the engine is accelerated in which the combustion noise becomes large or a phenomenon similar to engine knocking tends to occur, and so on. Thus, it is possible to reduce an amount of the fluid to be used and/or to decrease an amount of energy to compress the fluid.

In the configurations above, it is also preferable that the predetermined acting timing at which said temperature un-uniformity adding means injects said high pressure fluid be set in a period from a timing at which the temperature un-uniformity of the air-fuel mixture gas becomes minimum to a timing which precedes by a predetermined crank angle prior to the fuel pyrolysis starting timing (i.e., during the middle phase of the compression stroke).

During the early phase of the compression stroke, the mixing of the air-fuel mixture gas proceeds rapidly due to the turbulent flow in the combustion chamber. Therefore, even if the air-fuel mixture gas having a wide temperature distribution is formed (i.e., the temperature un-uniformity of the air-fuel mixture gas is made larger) during the early phase of the compression stroke, such wide temperature distribution diminishes (disappears). Thus, it is not possible to moderate the combustion and to lengthen the combustion period, by adding supplementarily (or enhancing) the un-uniformity of the air-fuel mixture gas during the early phase of the compression stroke (i.e., during a period from the beginning of the compression stroke to a timing at which the temperature un-uniformity of the air-fuel mixture gas becomes minimum), because the enhanced un-uniformity of the air-fuel mixture gas can not last till the late phase of the compression stroke in which the combustion reaction become active.

On the other hand, the combustion reaction proceeds extremely rapidly compared to the change in the degree of mixing the mixture gas, during the late phase of the compression stroke which starts from a timing which precedes by a predetermine crank angle prior to the fuel pyrolysis starting timing (especially, after the fuel pyrolysis starting timing). Therefore, adding supplementarily the temperature un-uniformity during this phase can not cause the combustion to proceed moderately, because the combustion reaction starts and proceeds rapidly before the fuel particles spread into the lowered temperature area by the mixing the mixture gas.

Accordingly, as the feature described above, if the temperature un-uniformity is enhanced by injecting the high pressure fluid during the middle phase of the compression stroke, the temperature un-uniformity does not disappear till a starting timing of the substantial combustion (e.g., the starting timing of the fuel pyrolysis) and the fuel particles can be appropriately mixed into the low temperature area at the starting timing of the substantial combustion. That is, it is possible to provide the air-fuel mixture gas with "the temperature un-uniformity which is significant and large in moderating the combustion" by injecting the high pressure fluid during the middle phase of the compression stroke. Therefore, the combustion becomes moderated and the combustion period is lengthened. As a result, it is avoided that the pressure rising rate becomes excessive, and thus, the combustion noise is reduced.

Further, it is preferable that the temperature un-uniformity adding means inject said high pressure fluid along a tangential direction of a bore of said cylinder.

By the feature above, the swirl flow is generated in the combustion chamber, because the high pressure fluid is injected into the combustion chamber along the tangential direction of the cylinder bore. Thus, the heat transfer is enhanced (or is promoted) between the air-fuel mixture gas and the wall of the cylinder whose temperature is lower than the air-fuel mixture gas. As a result, the air-fuel mixture gas is cooled in the vicinity of the wall of the cylinder, and thus, the temperature un-uniformity of the air-fuel mixture gas is formed more effectively.

The high pressure fluid may preferably be high pressure air. The air can be obtained from the atmosphere. Thus, a gas tank for accumulating the air and the like is not necessary. As a result, the apparatus can be simplified by using the high pressure air as the high pressure fluid.

The high pressure fluid may preferably be high pressure hydrogen or high pressure carbon monoxide. It is inferred that the hydrogen can suppress generation of an intermediate product which is formed before the fuel (or the gasoline) is self-ignited. In addition, hydrogen is not self-ignited easily (the self-ignitability is poor), but its combustion proceeds rapidly once ignited. Thus, the mixture gas including hydrogen and the fuel requires longer time in (or before) the self-ignition than the mixture gas which does not include hydrogen. To the contrary, carbon monoxide has characteristics that it is as easily self-ignited as gasoline (i.e., it has the same level of the self-ignitability as gasoline), but that its combustion proceeds after ignited more slowly than gasoline after it is ignited. Therefore, using the hydrogen or the carbon monoxide as the high pressure fluid enables the combustion period to be effectively lengthened not only due to the temperature un-uniformity of the air-fuel mixture gas but also due to the un-uniformity of concentration (concentration inhomogeneity) because of existence of the hydrogen or the carbon monoxide, each of which can delay the self-ignition timing and/or slow the combustion speed.

The high pressure fluid may preferably be high pressure combustion gas which is compressed combustion gas after emitted (or displaced) from the combustion chamber. A concentration of oxygen in the combustion gas is lower than a concentration of oxygen in the air. Thus, the self-ignition timing is delayed by injecting the combustion gas compared to by injecting the air. Further, the specific heat of the combustion gas is larger than the specific heat of the air. Therefore, a temperature in a portion of the air-fuel mixture gas where concentration of the combustion gas is higher increases more slowly. Accordingly, it is possible to effectively lengthen the combustion period not only by the temperature un-uniformity of the air-fuel mixture gas but also by the un-uniformity of concentration due to existence of the combustion gas which delays (or hinders) the self-ignition of the air-fuel mixture gas.

The high pressure fluid may preferably be high pressure water. The air-fuel mixture gas is partially cooled effectively by the injected water because of large latent heat and specific heat of the water. In addition, water can be compressed with less energy than compressible fluid (e.g., air) since water is incompressible fluid. Thus, it is possible to reduce energy consumed by a compressor mounted on a vehicle to obtain the high pressure fluid.

According to another aspect of the present invention, the control apparatus is applied to an engine including:

fuel injection means for injecting fuel into a combustion chamber defined by a cylinder and a piston;

spark ignition means exposed to the combustion chamber; and high pressure water injection means for injecting high pressure water into the combustion chamber.

This engine is a 2-cycle engine that repeats an expansion stroke, an exhaust stroke, a scavenging stroke, an intake stroke, and a compression stroke every 360° crank angle, and that is operated under either one of a pre-mixed charge self-ignition mode and a spark-ignition mode.

If a driving condition of the engine is within a self-ignition area, the engine is operated under the pre-mixed charge self-ignition mode. Under the pre-mixed charge self-ignition mode, air-fuel mixture gas including at least air and the fuel injected by the fuel injection means is formed in the combustion chamber prior to the beginning of the compression stroke and the formed air-fuel mixture gas is self-ignited to be combusted by being compressed during the compression stroke.

If the driving condition of the engine is within a spark-ignition area which is an area other than said self-ignition area, the engine is operated under the spark-ignition mode. Under the spark-ignition mode, air-fuel mixture gas including at least air and the fuel injected by the fuel injection means is spark-ignited by spark by said spark ignition means to be combusted after the air-fuel mixture gas is compressed during the compression stroke.

Further, the control apparatus comprising high pressure water injection control means. The high pressure water injection control means injects said high pressure water from said high pressure water injection means at a predetermined acting timing within a compression stroke prior to a fuel pyrolysis starting timing, if the operating mode of the engine is said pre-mixed charge self-ignition mode.

By this feature, the air-fuel mixture gas has the enhanced temperature un-uniformity at the starting timing of the substantial combustion, and thus, the combustion becomes moderated and the combustion period is lengthened. As a result, under the pre-mixed charge self-ignition mode, it is avoided that the pressure rising rate in the combustion chamber becomes excessive, and thus, the combustion noise is reduced.

In addition, the high pressure water injection control means injects said high pressure water from said high pressure water injection means during one of periods of the scavenging stroke, the intake stroke, and a period which partially overlaps both of the scavenging stroke and the intake stroke, if the operating mode of the engine is said spark-ignition mode.

By this feature, the entire air-fuel mixture gas is cooled by the turbulent flow occurring in the beginning of the compression stroke. As a result, air-filling (air-charge) efficiency is improved and knocking is controlled.

In this case, it is preferable that the high pressure water injection control means be configured so as to inject the high pressure water only when a load of the internal combustion engine is higher than a predetermined first high load threshold if the operating mode of the engine is said pre-mixed charge self-ignition mode.

By this feature, the high pressure water is injected, for instance, only when the engine is accelerated in which the combustion noise becomes large or a phenomenon similar to engine knocking tends to occur, and so on. Thus, it is possible to reduce an amount of the water to be used or to decrease an amount of energy to compress the water, while reducing the combustion noise.

Further, it is preferable that the high pressure water injection control means be configured so as to inject the high pressure water only when a load of the internal combustion engine is higher than a second predetermined high load threshold if the operating mode of the engine is said spark-ignition mode.

By this feature, the high pressure water is injected only when the load is high in which the air-filling efficiency needs to be increased and the knocking tends to occur. Thus, an amount of the consumption of the water can be reduced.

The high pressure fluid may be high pressure liquid fuel including alcohol which is harder to be self-ignited than said fuel. Alcohol acts to delay the self-ignition timing, and thus, the combustion may be moderated. Furthermore, since latent heat and specific heat of the alcohol are large, the air-fuel mixture gas is partially cooled efficiently by the injected alcohol.

According to another aspect of the present invention, the control apparatus is applied to an engine including:

fuel injection means for injecting fuel into a combustion chamber defined by a cylinder and a piston;

spark ignition means exposed to the combustion chamber; and high pressure liquid fuel injection means for injecting into the combustion chamber high pressure liquid fuel including alcohol which is harder to be self-ignited than the fuel.

This engine is a 2-cycle engine which repeats an expansion stroke, an exhaust stroke, a scavenging stroke, an intake stroke, and a compression stroke every 360° crank angle, and which is operated under either one of a pre-mixed charge self-ignition mode and a spark-ignition mode.

The engine is operated under the pre-mixed charge self-ignition mode if a driving condition of the engine is within a self-ignition area. Under the pre-mixed charge self-ignition mode, air-fuel mixture gas including at least air and the fuel injected by the fuel injection means is formed in the combustion chamber prior to the beginning of the compression stroke and the formed air-fuel mixture gas is self-ignited to be combusted by being compressed during the compression stroke.

The engine is operated under the spark-ignition mode if the driving condition of the engine is within a spark-ignition area which is an area other than said self-ignition area, in which air-fuel mixture gas including at least air and fuel injected by the fuel injection means is spark-ignited by spark by said spark ignition means to be combusted after the air-fuel mixture gas is compressed during the compression stroke.

The control apparatus comprising high pressure liquid fuel injection control means.

The high pressure liquid fuel injection control means injects said high pressure liquid fuel from said high pressure liquid fuel injection means at a predetermined acting timing within a compression stroke prior to a fuel pyrolysis starting timing, if the operating mode of the engine is said pre-mixed charge self-ignition mode.

By this feature, the air-fuel mixture gas has the enhanced temperature un-uniformity at the starting timing of the substantial combustion, and thus, the combustion becomes moderated and the combustion period is lengthened. As a result, under the pre-mixed charge self-ignition mode, it is avoided that the pressure rising rate in the combustion chamber becomes excessive, and thus, the combustion noise is reduced.

Further, the high pressure liquid fuel injection control means injects said high pressure liquid fuel from said high pressure liquid fuel injection means during one of periods of the scavenging stroke, the intake stroke, and a period which partially overlaps both of the scavenging stroke and the intake stroke, if the operating mode of the engine is said spark-ignition mode.

By this feature, the entire air-fuel mixture gas is cooled by the turbulent flow occurring in the beginning of the compression stroke. As a result, air-filling (air-charge) efficiency is improved and knocking is controlled.

In this case, it is preferable that the high pressure liquid fuel injection control means be configured so as to inject the high pressure liquid fuel only when a load of the internal combustion engine is larger than a first predetermined high load threshold if the operating mode of the engine is said pre-mixed charge self-ignition mode.

By this feature, the high pressure liquid fuel is injected, for instance, only when the engine is accelerated in which the combustion noise becomes large or a phenomenon similar to engine knocking tends to occur, and so on. Thus, it is possible to reduce an amount of the high pressure liquid fuel to be used or to decrease an amount of energy to compress the liquid fuel while reducing the combustion noise.

Further, it is preferable that said high pressure liquid fuel injection control means be configured so as to inject the high pressure liquid fuel, for instance, only when a load of the internal combustion engine is higher than a second predetermined high load threshold if the operating mode of the engine is said spark-ignition mode.

By this feature, the high pressure liquid fuel is injected only when the load is high in which air-filling efficiency needs to be increased and the knocking tends to occur. Thus, an amount of the high pressure liquid fuel consumed can be reduced.

Also, the high pressure fluid may be synthetic gas including carbon monoxide and hydrogen which are obtained by partially oxidizing the fuel.

Hydrogen is not self-ignited easily (the self-ignitability is poor), but its combustion proceeds rapidly once ignited. Carbon monoxide has characteristics that it is as easily self-ignited as gasoline (i.e., it has the same level of the self-ignitability as gasoline), but that its combustion proceeds after ignited more slowly than gasoline after it is ignited. Thus, the mixture gas including synthetic gas and the fuel requires longer time in the self-ignition and/or the combustion than the mixture gas which does not include the synthetic gas. Therefore, using the synthetic gas as the high pressure fluid enables the combustion period to be effectively lengthened not only by the temperature un-uniformity of the air-fuel mixture gas but also by the un-uniformity of concentration due to existence of the hydrogen or the carbon monoxide which can delay the self-ignition timing and/or slow the combustion speed.

Further, the temperature un-uniformity adding means may preferably be configured so as to inject said fuel as said high pressure fluid from said fuel injection means.

By this feature, the air-fuel mixture gas is partially cooled effectively because of large latent heat and specific heat of the fuel injected supplementarily.

According to another aspect of the present invention, the control apparatus is applied to an engine including:

- fuel injection means for injecting fuel into a combustion chamber defined by a cylinder and a piston;
- spark ignition means exposed to the combustion chamber; and
- high pressure fluid injection means for injecting high pressure fluid into the combustion chamber.

This engine is operated under either one of a pre-mixed charge self-ignition mode and a spark-ignition mode. If a driving condition of the engine is within a self-ignition area, the engine is operated under the pre-mixed charge self-ignition mode. Under the pre-mixed charge self-ignition mode, air-fuel mixture gas including at least air and the fuel injected by the fuel injection means is formed in the combustion chamber prior to the beginning of a compression stroke and the formed air-fuel mixture gas is self-ignited to be combusted during the compression stroke. If the driving condition of the engine is within a spark-ignition area which is an area other than said self-ignition area, the engine is operated under the spark-ignition mode. Under the spark-ignition mode, air-fuel mixture gas including at least air and the fuel injected by the fuel injection means is spark-ignited by spark by said spark ignition means to be combusted after the air-fuel mixture gas is compressed during the compression stroke.

The control apparatus for this engine comprises high pressure fluid injection control means. The high pressure fluid injection control means injects said high pressure fluid from said high pressure fluid injection means when crank angle reaches a predetermined crank angle, if the operating mode of the engine is said pre-mixed charge self-ignition mode, and injects said high pressure fluid from said high pressure fluid injection means when crank angle reaches another predetermined crank angle different from said predetermined crank angle, if the operating mode of the engine is said spark-ignition mode.

In this case, the high pressure fluid is a fluid including any one of air, hydrogen, carbon monoxide, combustion gas which is compressed combustion gas after emitted from the combustion chamber, water, liquid fuel including alcohol, synthetic gas including carbon monoxide and hydrogen which are obtained by partially oxidizing the fuel, and said fuel.

By this feature, under the pre-mixed charge self-ignition mode, the high pressure fluid is injected at a crank angle which is different form a crank angle at which the high pressure fluid is injected under the spark-ignition mode. For instance, when the engine is operated under pre-mixed charge self-ignition mode, the high pressure fluid is injected at a predetermined timing within the compression stroke prior to the fuel pyrolysis starting timing of the fuel included in the air-fuel mixture gas. This enables the air-fuel mixture gas to have the enhanced temperature un-uniformity at the starting timing of the substantial combustion, and thus, the combustion becomes moderated and the combustion period is lengthened. As a result, under the pre-mixed charge self-ignition mode, it is avoided that the pressure rising rate in the combustion chamber becomes excessive, and thus, the combustion noise is reduced.

Furthermore, for instance, when the engine is operated under spark-ignition mode, the high pressure fluid is injected at another predetermined timing prior to the compression stroke. This causes the entire air-fuel mixture gas to be cooled. As a result, air-filling (air-charge) efficiency is improved and knocking is controlled when the engine is operated by the spark-ignition combustion.

As described above, by the control apparatus according to the present aspect, the high pressure fluid injection means is effectively utilized to inject the high pressure fluid at appropriate timings suitable for the engine operating modes. Thus, it is possible to improve the fuel efficiency and/or to reduce the noise.

In this case, it is preferable that the high pressure fluid injection control means be configured so as to inject the high pressure fluid only when a load of the internal combustion engine is larger than a first predetermined high load threshold if the operating mode of the engine is said pre-mixed charge self-ignition mode.

By this feature, the high pressure fluid is injected only when the engine is accelerated in which the combustion noise becomes large or a phenomenon similar to engine knocking tends to occur, and so on. Thus, it is possible to reduce an amount of the fluid to be used or to decrease an amount of energy to compress the fluid, while suppressing the combustion noise.

Furthermore, in this case it is preferable that the high pressure fluid injection control means be configured so as to inject the high pressure fluid only when a load of the internal combustion engine is larger than a second predetermined high load threshold if the operating mode of the engine is said spark-ignition mode.

By this feature, the high pressure fluid is injected only when the load is high in which the air-filling efficiency needs to be increased and the knocking tends to occur. Thus, an amount of the consumption of the fluid can be reduced.

According to still another aspect of the present invention, a control apparatus is applied to an engine capable of a pre-mixed charge compression ignition combustion. The engine has fuel injection means for injecting fuel into a combustion chamber defined by a cylinder and a piston. In the engine, air-fuel mixture gas including at least air and fuel injected by the fuel injection means is formed in the combustion chamber prior to the beginning of a compression stroke, and the air-fuel mixture gas is self-ignited to be combusted (burned) by compressing the air-fuel mixture gas during the compression stroke, when a driving condition of the engine is within a self-ignition area.

The control apparatus for this engine comprises fuel injection control means. The fuel injection control means injects from said fuel injection means a part of fuel of an fuel amount required by the engine prior to the beginning of the compression stroke and injects from said fuel injection means the rest of the fuel of the amount required by the engine at a predetermined timing within the compression stroke prior to a fuel pyrolysis starting timing of said injected fuel, if a load of the engine is in a high load area where the load is higher than a high load threshold.

The fuel injection control means injects from said fuel injection means all of fuel of the fuel amount required by the engine prior to the compression stroke, if the load of the engine is in a middle load area where the load is higher than a middle load threshold which is lower than said high load threshold.

The fuel injection control means injects from said fuel injection means injects from said fuel injection means all of fuel of the fuel amount required by the engine during the compression stroke, if the load of the engine is in a low load area where the load is lower than said middle load threshold.

By the features above, when a load of the engine is in a high load area where the load is higher than a high load threshold, a part of fuel of an fuel amount required by the engine is injected prior to the beginning of the compression stroke. Further, the rest of the fuel of the amount required by the engine is injected at a predetermined timing within the compression stroke prior to a fuel pyrolysis starting timing of said injected fuel. Thus, the homogeneous charge (air-fuel mixture gas) formed by the fuel injection prior to the beginning of the compression stroke is partially cooled by large latent heat and specific heat of the fuel which is injected supplementarily at the predetermined timing within the compression stroke prior to the fuel pyrolysis starting timing of said injected fuel.

This allows the air-fuel mixture gas to have large (or enhanced) temperature un-uniformity of the air-fuel mixture gas at the fuel pyrolysis starting timing. Accordingly, the combustion becomes moderated and the combustion period is lengthened. As a result, it is avoided that the pressure rising rate becomes excessive, and therefore, the noise combustion noise is reduced, under the pre-mixed charge self-ignition mode.

In addition, when the load of the engine is in the middle load area where the load is higher than the middle load threshold which is lower than said high load threshold, all of fuel of the fuel amount required by the engine is injected prior to the compression stroke. By this feature, it is possible to form the homogeneous charge, and thus, to realize the stable self-ignition combustion.

Furthermore, when the load of the engine is in the low load area where the load is lower than said middle load threshold, all of fuel of the fuel amount required by the engine is injected during the compression stroke. By this feature, it is possible to realize the stable self-ignition combustion even with a small amount of fuel because weak stratified air-fuel mixture gas is obtained.

In addition, the control apparatus of this aspect adds the temperature un-uniformity by injecting fuel supplementarily from the existing fuel injection means. Thus, no fluid other than the fuel is required. Also, any injection valves and the like for injecting fluid other than the fuel are not required. Thus, the system can be simplified and lightened, and the cost of the system is lowered.

According to still another aspect of the present invention, the control apparatus is applied to an engine including fuel injection means for injecting fuel into a combustion chamber defined by a cylinder and a piston. This engine is a 2-cycle engine that repeats an expansion stroke, an exhaust stroke, a scavenging stroke, an intake stroke, and a compression stroke every 360° crank angle. The control apparatus comprises fuel injection control means.

The fuel injection control means injects from said fuel injection means a part of fuel of an fuel amount required by the engine during one of periods of the scavenging stroke, the intake stroke, and a period which partially overlaps both of the scavenging stroke and the intake stroke, and injects from said fuel injection means the rest of the fuel of the amount required by the engine at a predetermined timing within the compression stroke prior to a fuel pyrolysis starting timing of said injected fuel, if a load of the engine is in a high load area where the load is higher than a high load threshold.

By this feature, the homogeneous charge (air-fuel mixture gas) formed by the fuel injection during one of periods of the scavenging stroke, the intake stroke, and a period which partially overlaps both of the scavenging stroke and the intake stroke, is partially cooled by large latent heat and specific heat of the fuel which is injected supplementarily at the predetermined timing within the compression stroke prior to the fuel pyrolysis starting timing of said injected fuel.

This allows the air-fuel mixture gas to have large (or enhanced) temperature un-uniformity of the air-fuel mixture gas at the starting timing of the substantial combustion, and thus, the combustion becomes moderated and the combustion period is lengthened. As a result, under the pre-mixed charge self-ignition mode, it is avoided that the pressure rising rate in the combustion chamber becomes excessive, and thus, the combustion noise is reduced.

Further, the fuel injection control means injects from said fuel injection means all of fuel of the fuel amount required by the engine during one of periods of the scavenging stroke, the intake stroke, and a period which partially overlaps both of the scavenging stroke and the intake stroke, if the load of the engine is in a middle load area where the load is higher than a middle load threshold which is lower than said high load threshold.

By this feature, it is possible to form the homogeneous charge, and thus, to realize the stable self-ignition combustion.

Furthermore, the fuel injection control means injects from said fuel injection means all of fuel of the fuel amount required by the engine during the compression stroke, if the load of the engine is in a low load area where the load is lower than said middle load threshold.

By this feature, it is possible to realize the stable self-ignition combustion even with a small amount of fuel because weak stratified air-fuel mixture gas is obtained.

In addition, the control apparatus of this aspect adds the temperature un-uniformity by injecting fuel supplementarily from the existing fuel injection means. Thus, no fluid other than the fuel is required. Also, any injection valves and the like for injecting fluid other than the fuel are not required. Thus, the system can be simplified and lightened, and the cost of the system is lowered.

BRIEF DESCRIPTION OF THE DRAWINGS

Various other objects, features and many of the attendant advantages of the present invention will be readily appreciated as the same becomes better understood by reference to the following detailed description of the preferred embodiments when considered in connection with the accompanying drawings, in which.

DESCRIPTION OF THE BEST EMBODIMENTS

Embodiments of a control apparatus for an internal combustion engine according to the present invention will next be described in detail. Each control apparatuses of the embodiments is applied to the internal combustion engine capable of pre-mixed charge compression ignition combustion (pre-mixed charge (or homogeneous charge) compression ignition combustion engine), and is an apparatus to moderate the self-ignition (spontaneous ignition) combustion by appropriately controlling the temperature un-uniformity of the air-fuel mixture gas formed in the combustion chamber (or the spatial temperature distribution of the air-fuel mixture). Accordingly, first of all, an effect on the self-ignition combustion caused by the temperature un-uniformity of the air-fuel mixture gas in the combustion chamber is described.

Figure 1:
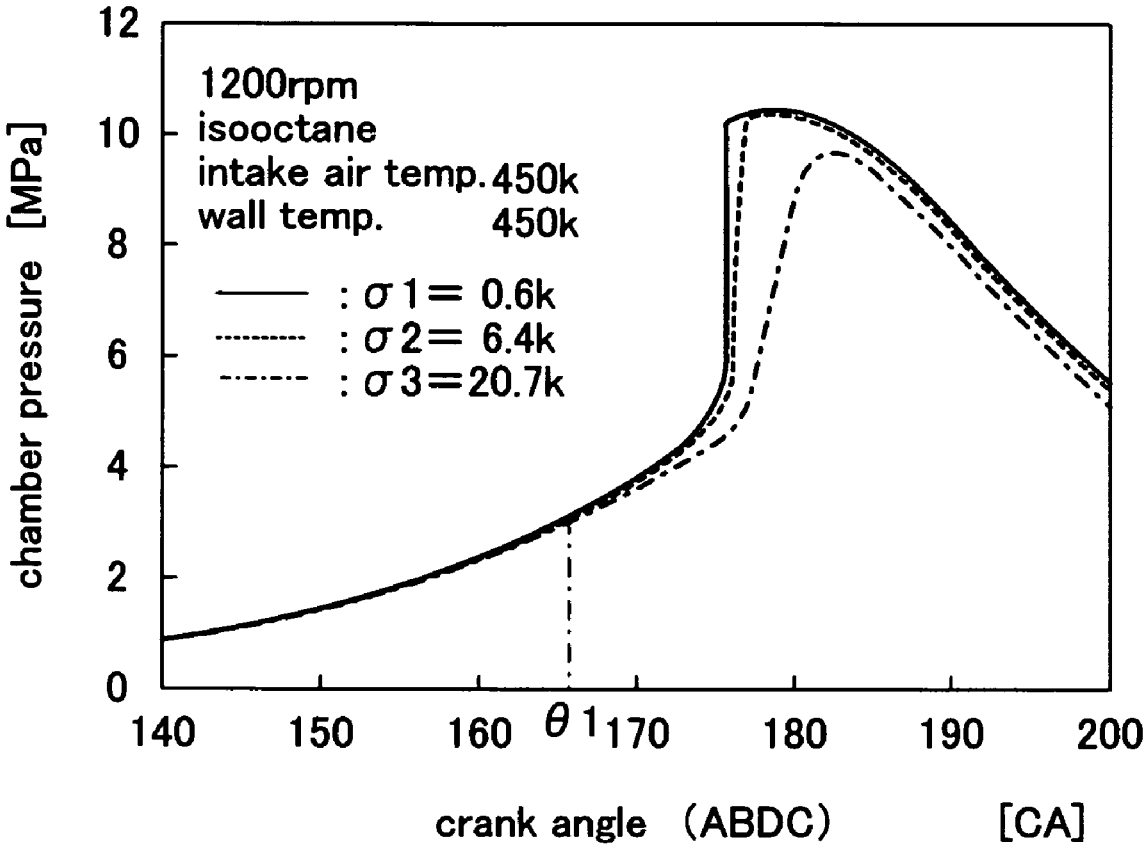
FIG. 1 is a graph showing changes in pressure of air-fuel mixture gas in a combustion chamber with respect to crank angles.
Figure 2:
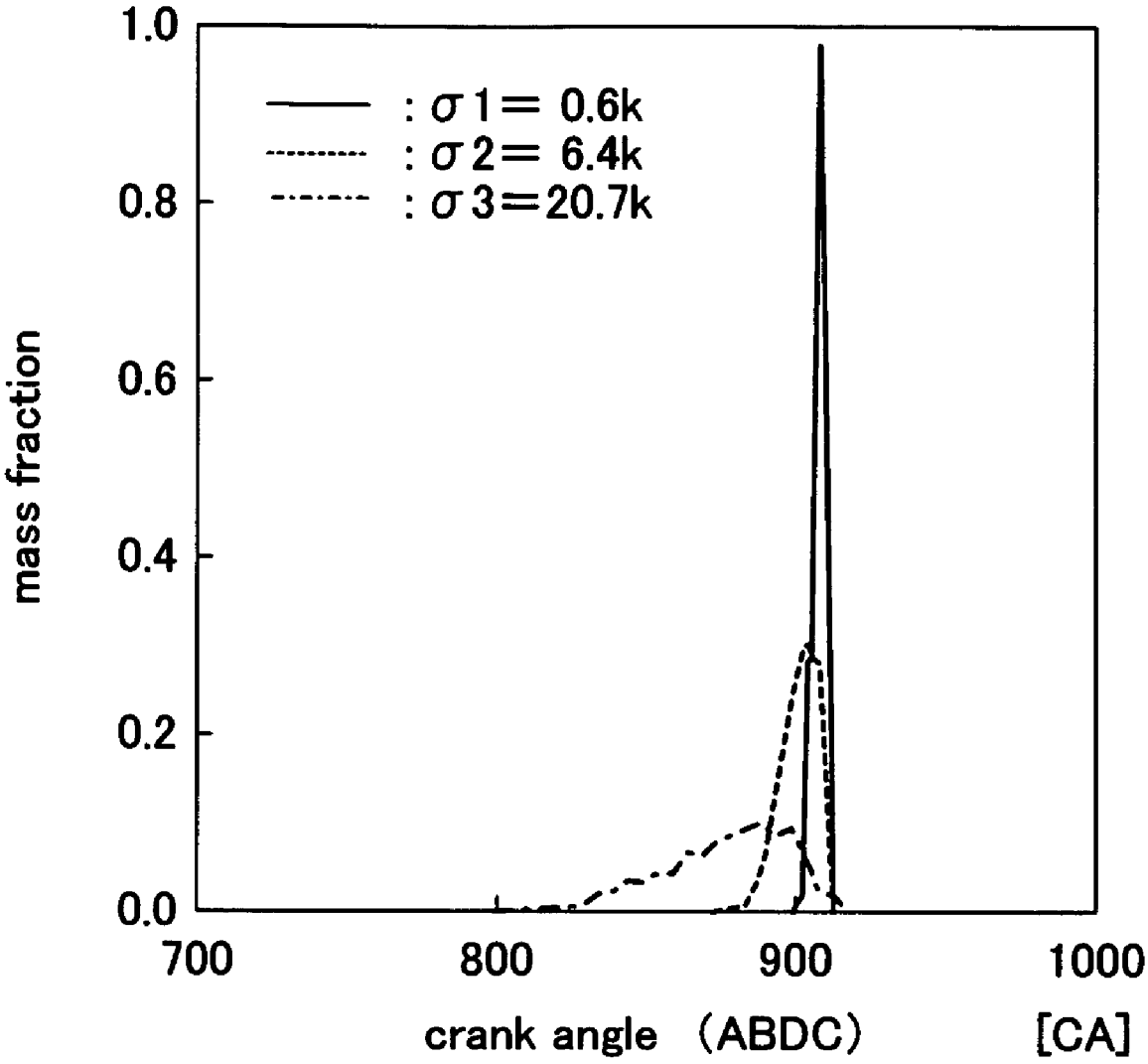
FIG. 2 is a graph showing temperature distributions for standard deviations with respect to crank angles.

FIG. 1 shows a result, obtained by a simulation, concerning changes in pressure of the air-fuel mixture gas in the combustion chamber (hereinafter sometimes called "chamber pressure") with respect to crank angles for each of different temperature distributions of the air-fuel mixture at a fuel pyrolysis starting timing $\theta 1$ (which is a timing at which concentration (or density) of the fuel reaches 90% of the initial concentration of the fuel, or at which 10% of the fuel is pyrolyzed). The chamber pressures shown by a solid line, a dotted line, and an alternate long and short dash line in FIG. 1 correspond to the temperature distributions shown by a solid line, a dotted line, and an alternate long and short dash line in FIG. 2, respectively. The temperature distributions shown by a solid line, dotted line, and an alternate long and short dash line in FIG. 2 show temperature distributions at standard deviation $\sigma 1$=0.6K (the temperature un-uniformity is small), standard deviation $\sigma 2$=6.4K (the temperature un-uniformity is middle), and standard deviation $\sigma 3$=20.7K (the temperature un-uniformity is large), respectively.

As shown by the solid line in FIG. 1, if the temperature un-uniformity is small at the fuel pyrolysis starting timing θ1, the chamber pressure increases extremely rapidly and the combustion completes in a short time. On the other hand, as shown by the dotted line and by the alternate long and short dash line in FIG. 1, as the temperature un-uniformity becomes larger, the rising rate in the chamber pressure becomes lower and the combustion proceeds more moderately. Therefore, it can be understood that it is possible to moderate the self-ignition combustion if the temperature un-uniformity of the air-fuel mixture gas in the combustion chamber can exist at the fuel pyrolysis starting timing θ1.

Meanwhile, if the air-fuel mixture gas burns at different combustion reaction speeds from its portion to portion rather than burning at a uniform speed for the entire air-fuel mixture, it is possible to moderate the combustion without changing its self-ignition timing.

It is known that the combustion reaction speed, as shown by a formula (1) below, depends on the concentration (or density) of the components relating to the combustion of the air-fuel mixture gas (mixture) and the temperature of the same, where the components relating to the combustion is a fuel and an oxidizing reagent, and hereinafter simply called "the combustion reaction components".

$$\text{Combustion reaction speed}=K\cdot(\text{fuel concentration})^{a}\cdot(\text{oxidizing reagent})^{b}\cdot\exp(-Ea/R\cdot T) \quad (1)$$

In the formula (1), K, a, and b are constants, Ea is activation energy, R is gas constant, and T is temperature of the air-fuel mixture gas (mixture).

As understood above, having un-uniformity in the temperature and in the concentration of the combustion reaction components makes is possible to moderate the combustion by burning the mixture at different combustion reaction speeds from its portion to portion. It is also be said that, from the formula (1) above, the combustion reaction speed changes in proportion to power of the concentration of the combustion reaction components, however, it changes depending on the temperature of the air-fuel mixture gas exponentially. Therefore, it can be said that the combustion changes depending on the temperature of the air-fuel mixture gas more sensitively compared to the concentration of the combustion reaction components.

Figure 3:
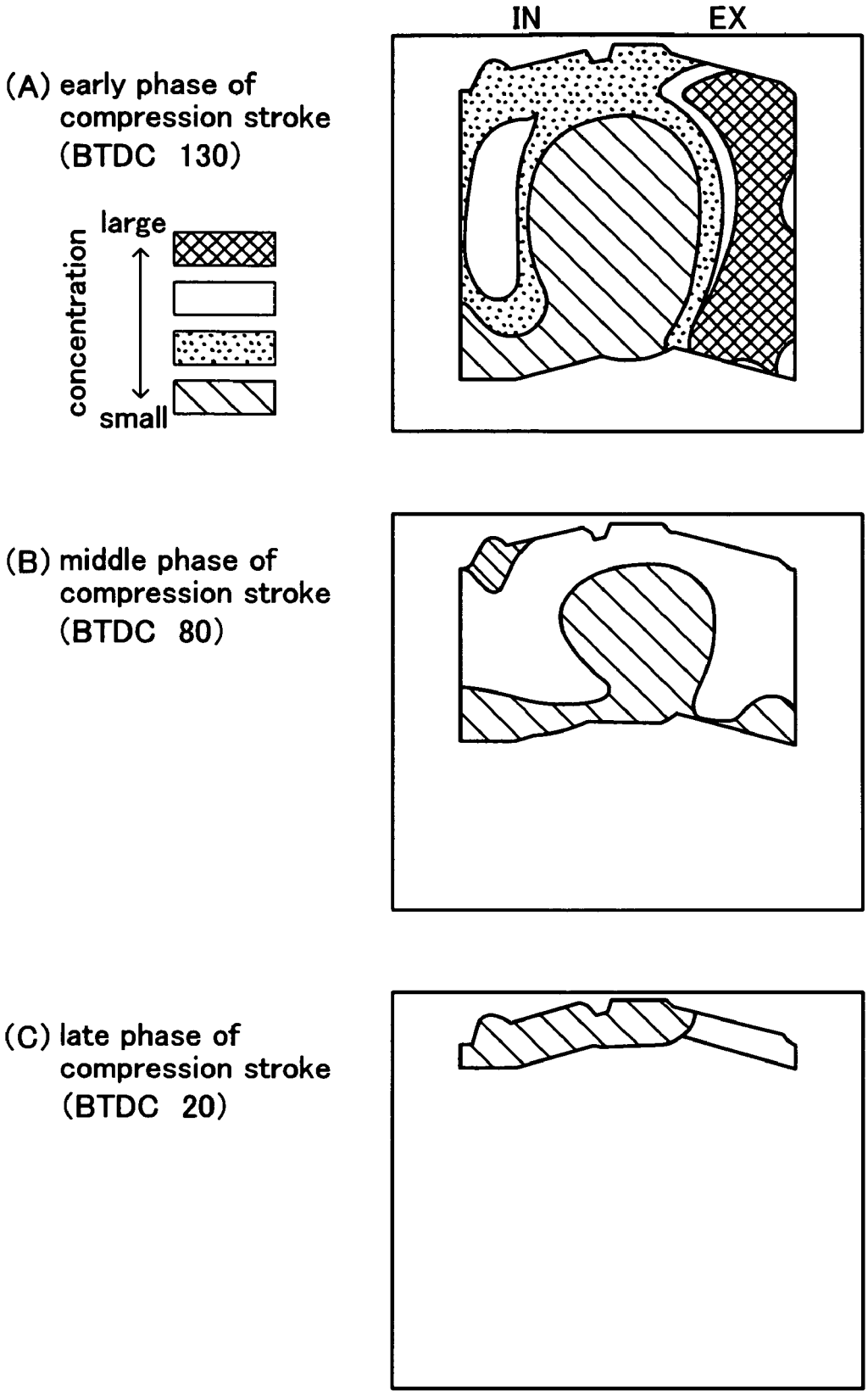
FIG. 3 schematically shows changes in distribution of concentration of combustion reaction components during a compression stroke.
Figure 4:
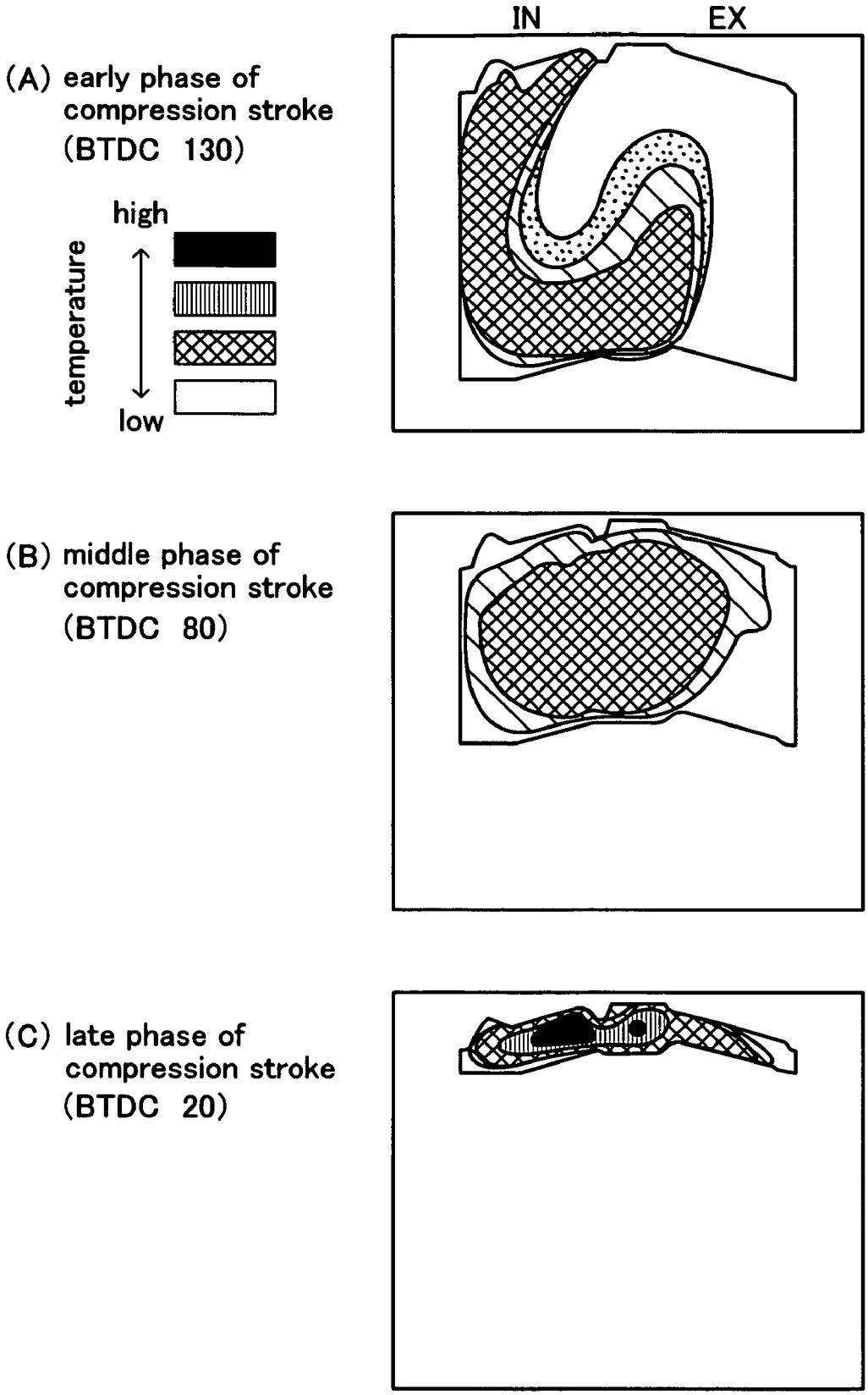
FIG. 4 schematically shows changes in temperature distribution of air-fuel mixture gas during a compression stroke.

In an actual internal combustion engine, a turbulent flow (e.g., turbulent flow caused by intake air) occurred in the combustion chamber causes heat and mass transfer. The transfer changes the distribution of concentration of the combustion reaction components and the temperature distribution of the air-fuel mixture gas. In view of above, the examination is made with regard to changes in distribution of concentration of the combustion reaction components and in the temperature distribution of the air-fuel mixture gas during the compression stroke based on a simulation. FIGS. 3 and 4 show the result.

As understood from the changes in distribution of concentration of the combustion reaction components shown in FIG. 3, the un-uniformity of the concentration is large at the beginning of the compression stroke, however, substantially disappears (or diminishes) by the late phase of the compression stroke due to the strong turbulent flow occurring during the early phase of the compression stroke.

On the contrary, as understood from the changes in the temperature distribution of the air-fuel mixture gas shown in FIG. 4, the temperature un-uniformity becomes smaller from the early phase to the middle phase of the compression stroke, however, becomes larger again from the middle phase to the late phase of the compression stroke. It is inferred that this is caused by the heat transfer (the heat transmission) between the cylinder-wall (the chamber wall) and the air-fuel mixture.

Note that, in this specification, the early phase of the compression stroke is defined as a period (time period) from the timing at which an intake valve(s) is closed to the timing at which the temperature un-uniformity of the air-fuel mixture gas becomes minimum (the distribution of the mixture temperature are possibly equalized). Also, the middle phase of the compression stroke is defined as a period (time period) from the end of the early phase of the compression stroke to the timing that precedes by a predetermined crank angle θy (e.g. 20 to 30° crank angle) prior to the fuel pyrolysis starting timing θ1. Further, the late phase of the compression stroke is defined as a period (time period) from the end of the middle phase to the self-ignition timing. The self ignition timing is defined as 5% of maximum possible heat quantity has generated, for the sake of convenience.

To sum up the description above, it may be difficult to maintain the un-uniformity in the concentration distribution of the combustion reaction components from the beginning of the compression stroke to the late phase of the compression stroke, and the effect on the self-ignition combustion by the concentration distribution of the combustion reaction components may be relatively small. Further, it is not so difficult to maintain the un-uniformity in the temperature distribution of the air-fuel mixture gas till the late phase of the compression stroke compared to the un-uniformity in the concentration distribution of the combustion reaction components, and the effect on the self-ignition combustion by the temperature distribution of the air-fuel mixture gas is relatively large. Therefore, in the pre-mixed charge compression ignition combustion engine, it can be said that it is more effective to form the (un-uniformity of) temperature distribution during the compression stroke in order to moderate the combustion and to lengthen the combustion time period.

Figure 5:
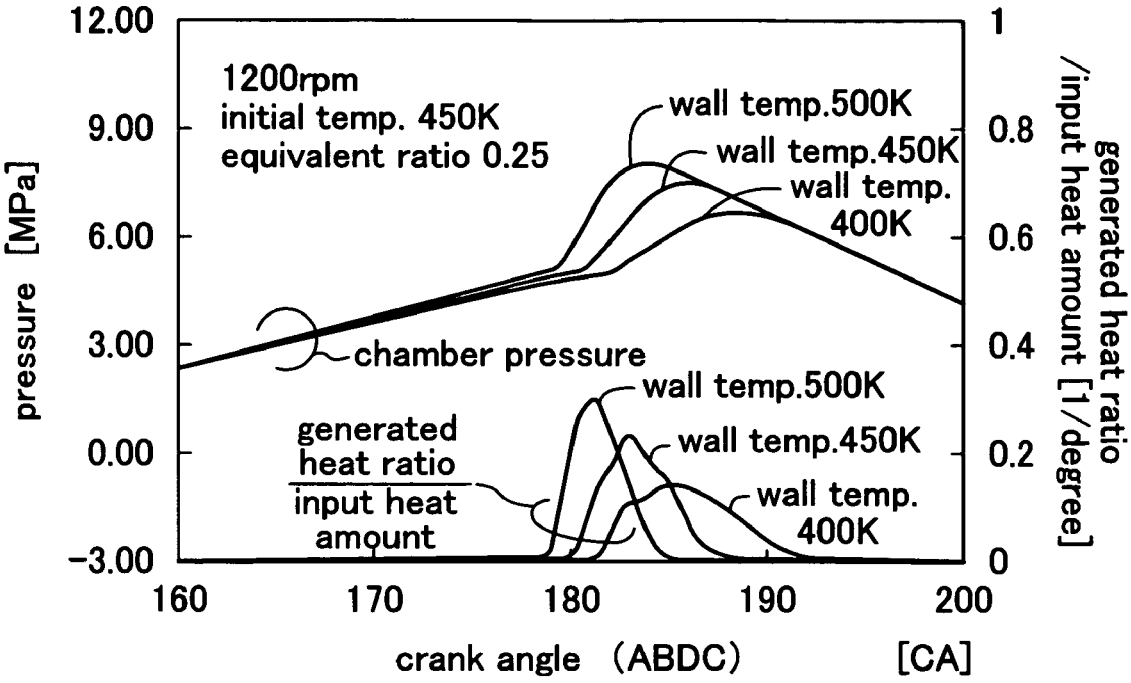
FIG. 5 is a graph showing changes in pressure of air-fuel mixture gas in a combustion chamber with respect to crank angles and showing changes in generated heat ratio with respect to input heat amount.

Next, relation between cylinder wall temperature and combustion period (time period) was examined using a simulation. As mentioned above, it is inferred that the temperature un-uniformity of the air-fuel mixture gas is brought by the heat transfer between the cylinder wall and the mixture gas. The result is shown in FIG. 5. As understood from FIG. 5, the combustion period becomes longer since the temperature distribution becomes wider (i.e., the temperature un-uniformity becomes larger) as the cylinder wall temperature becomes lower. In other words, increasing an amount of the heat transfer between the cylinder wall and the mixture gas is effective to lengthen the combustion period.

Next, an examination was made on what part of period during the compression stroke in which the temperature distribution (the temperature un-uniformity) is formed is effective for moderating the combustion (lengthening the combustion period). Assuming that the combustion reaction proceeds extremely rapidly compared to the turbulent flow in the combustion chamber, the combustion is not virtually affected by the turbulent flow. On the other hand, assuming that the combustion reaction proceeds extremely slowly compared to the turbulent flow in the combustion chamber, the combustion changes depending strongly on mixing phenomena of the air-fuel mixture gas caused by the turbulent flow in the combustion chamber.

Figure 6:
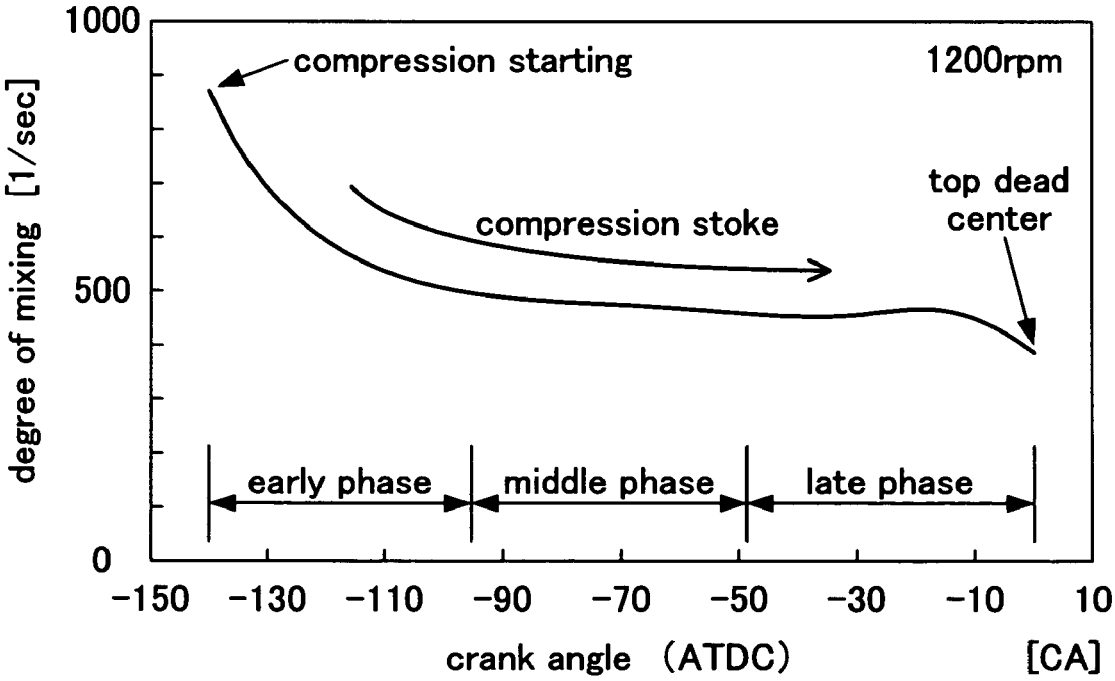
FIG. 6 is a graph showing changes in degree of mixing gas during a compression stroke.

FIG. 6 shows result obtained by calculations on changes in degree of mixing gas during the compression stroke. From the calculations, it is revealed that the degree of mixing gas diminishes immediately after the beginning of the compression stroke (early phase of the compression stroke) and remains unchanged virtually for a period from the middle phase to the late phase of the compression stroke. That is, hyper active mixing of the air-fuel mixture gas by the turbulent flow occurs during the early phase of the compression stroke.

Figure 7:
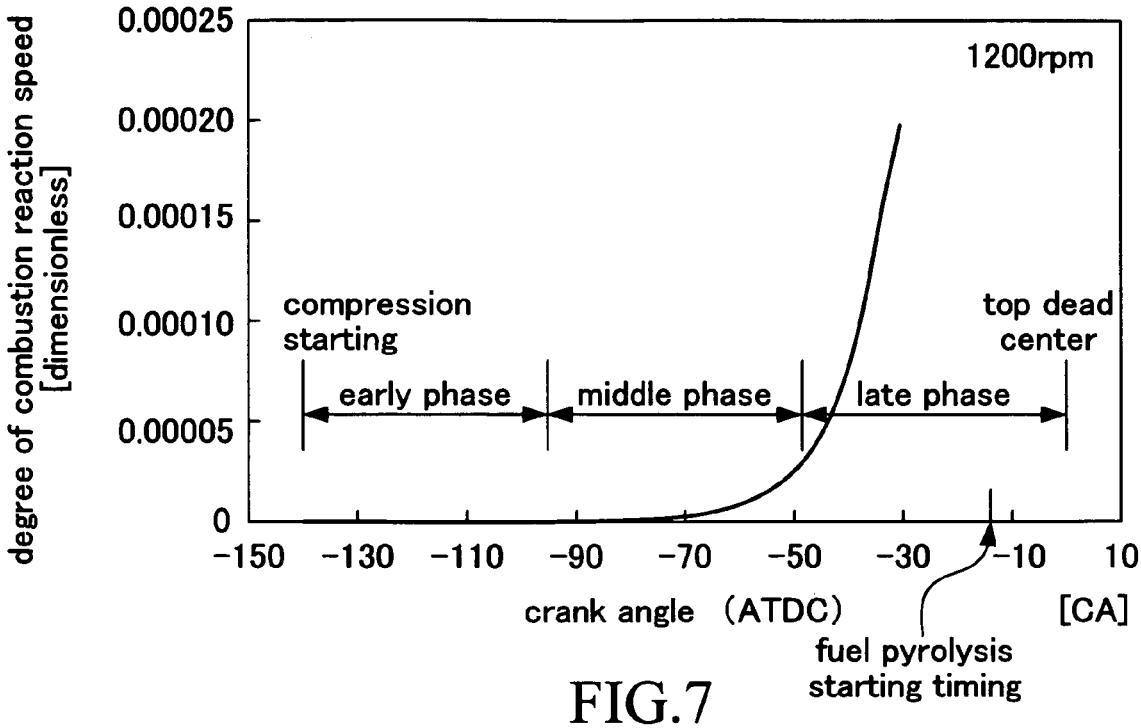
FIG. 7 is a graph changes in degree of the combustion reaction speed (or chemical reaction speed) during a compression stroke.

FIG. 7 shows result obtained by calculations on changes in degree of the combustion reaction speed (or chemical reaction speed) during the compression stroke. From the calculations, it is revealed that the combustion reaction does not virtually proceed for a period from the early phase to the middle phase of the compression stroke due to low temperature of the air-fuel mixture gas, however, proceeds at once (or drastically) when the temperature of the air-fuel mixture gas becomes high in the late phase of the compression stroke.

Following conclusion is drawn from the examinations described above.

(1) During the early phase of the compression stroke, the mixing of the air-fuel mixture gas proceeds rapidly due to the turbulent flow. Therefore, even if the air-fuel mixture gas having a wide temperature distribution is formed (i.e., the temperature un-uniformity of the air-fuel mixture gas is made large), such wide temperature distribution can not remain till the late phase of the compression stroke in which the combustion reaction becomes active. Thus, it is not possible to lengthen the combustion period by forming the air-fuel mixture gas having the wide temperature distribution (or the large un-uniformity in temperature) during the early phase of the compression stroke.

(2) During the middle phase of the compression stroke, the mixing of the air-fuel mixture gas proceeds relatively moderately. On the contrary, the combustion reaction becomes more active gradually. This combustion reaction is "pre-reaction led to (prior to) self-ignition" which is slower than the explosive combustion reaction (after the ignition) which proceeds at an explosive pace. This pre-reaction proceed relatively moderately, and therefore, the mixture of the air-fuel mixture gas caused by the turbulence flow is not diminished (disappeared) by the pre-reaction. Accordingly, the mixture of the air-fuel mixture can have an effect on the explosive combustion reaction which occurs later. Thus, enhancing (or increasing, or strengthen) the temperature un-uniformity of the air-fuel mixture gas during the middle phase of the compression stroke (i.e., some operation is performed to the air-fuel mixture gas in order to dispread the spatial temperature distribution of the air-fuel mixture) enables the combustion to proceed moderately. In addition, the mixing by the turbulence flow activates (or enhance) the heat transfer between the air-fuel mixture gas and the cylinder wall, and mixes the air-fuel mixture gas which is cooled by the cylinder wall with the remaining air-fuel mixture gas. These also enable the combustion to become moderate effectively.

(3) During the late phase of the compression stroke (especially, after the fuel pyrolysis starting timing), the combustion reaction proceeds extremely rapidly compared to the change in the degree of mixing the mixture gas. Therefore, adding supplementarily the temperature un-uniformity during this phase can not cause the combustion to proceed moderately, because the combustion starts before the fuel particles spread into the lowered temperature area.

The views described above draw a conclusion that enhancing the temperature un-uniformity of the air-fuel mixture gas at the fuel pyrolysis starting timing by utilizing the mixing caused by the turbulence flow during the middle phase of the compression stroke is effective for moderating the combustion to lengthen the combustion period.

Figure 8:
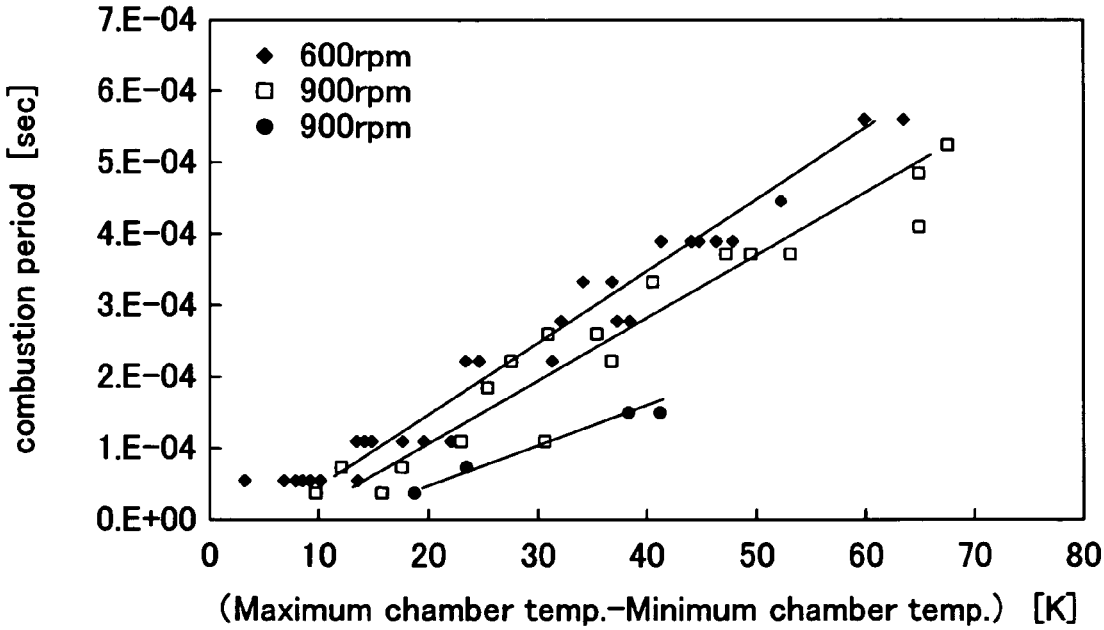
FIG. 8 is a graph showing changes in combustion period with respect to temperature distribution of air-fuel mixture in a combustion chamber at a fuel pyrolysis starting timing (difference between the maximum temperature and the minimum temperature in a combustion chamber)

In fact, examination by calculations was made on how the combustion period changes when the temperature distribution at the fuel pyrolysis starting timing is changed. FIG. 8 shows the result. As understood from FIG. 8, the combustion period is proportional to the difference between the maximum temperature (highest chamber temperature) and the minimum temperature (lowest chamber temperature) of the air-fuel mixture in the combustion chamber at the fuel pyrolysis starting timing. For example, the combustion period is doubled when the temperature difference is changed from 20 k to 40 k. Accordingly, validity of the above conclusion that enhancing the temperature un-uniformity of the air-fuel mixture gas at the fuel pyrolysis starting timing can effectively change the combustion is confirmed.

Each of the embodiments of the control apparatus for the internal combustion engine according to the present invention has been accomplished based on the above studies, provides some special operation in order to enhance the temperature un-uniformity of the air-fuel mixture gas during the middle phase of the compression stroke, and utilize the operation and the mixing of the air-fuel mixture gas caused by the turbulence flow during the middle phase of the compression stroke to enhance the temperature un-uniformity of the air-fuel mixture gas at the fuel pyrolysis starting timing in order to moderate the combustion.

Each of the embodiments of the control apparatus for the internal combustion engine according to the present invention will next be described in detail with reference to the drawings.

First Embodiment

Figure 9:
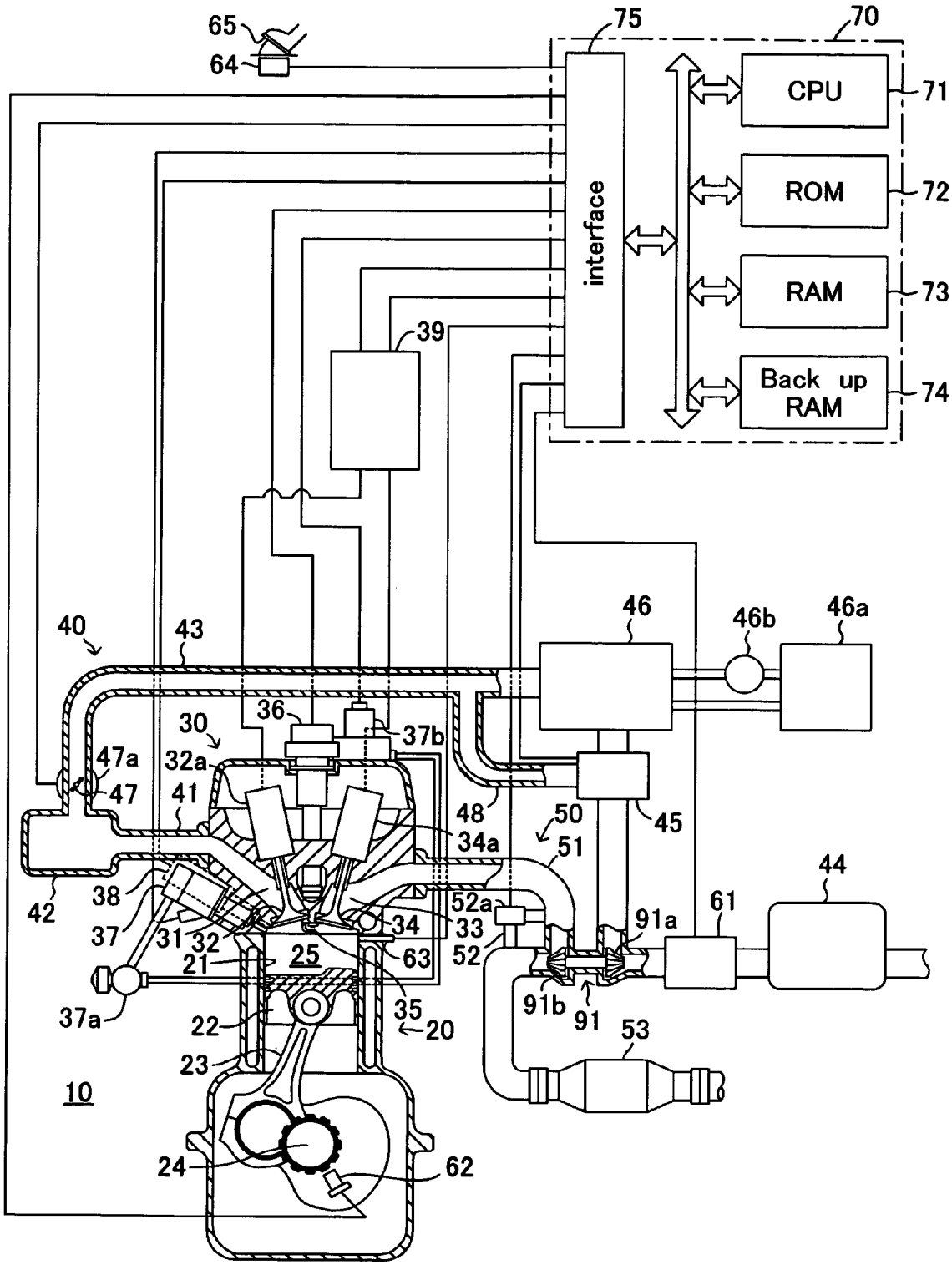
FIG. 9 is a schematic configuration diagram of a system in which a control apparatus according to a first embodiment of the present invention is applied to a 2-cycle pre-mixed charge compression ignition combustion engine.

FIG. 9 shows a schematic configuration of a system configured such that a control apparatus for an internal combustion engine according to a first embodiment of the present invention is applied to a pre-mixed (homogeneous) charge compression ignition (self-ignition or spontaneous ignition) 2-cycle internal combustion engine 10. The 2-cycle engine is an engine in which repeats an expansion (combustion and expansion) stroke, an exhaust stroke, a scavenging stroke, an intake (or charging stroke), and a compression stroke every 360° crank angle.

The pre-mixed charge compression ignition internal combustion engine 10 includes a cylinder block section 20 including a cylinder block, a cylinder block lower case, an oil pan, etc.; a cylinder head section 30 fixed on the cylinder block section 20; an intake system 40 for supplying air (new air) to the cylinder block section 20; and an exhaust system 50 for emitting exhaust gas from the cylinder block section 20 to the exterior of the engine.

The cylinder block section 20 includes cylinders 21, pistons 22, connecting rods 23, and crankshafts 24. The piston 22 reciprocates within the cylinder 21. The reciprocating motion of the piston 22 is transmitted to the crankshaft 24 via the connecting rod 23, whereby the crankshaft 24 rotates. The cylinder 21 and the head of the piston 22, together with a cylinder head section 30, form a combustion chamber 25.

The cylinder head section 30 includes an intake port (or a charging port) 31 communicating with the combustion chamber 25; an intake valve 32 for opening and closing the intake port 31; an intake valve driving unit 32*a* for driving the intake valve 32; an exhaust port 33 communicating with the combustion chamber 25; an exhaust valve 34 for opening and closing the exhaust port 33; an exhaust valve driving unit 34*a* for driving the exhaust valve 34; a spark plug 35; an igniter 36 including an ignition coil for generating a high voltage to be applied to the spark plug 35; an injector (gasoline fuel injection valve, fuel injection means) 37 for injecting fuel (gasoline fuel) into the combustion chamber 25; and an air injection valve 38. The intake valve driving unit 32*a* and the exhaust valve driving unit 34*a* are connected to a driving circuit 39.

The intake valve driving unit 32*a* and the exhaust valve driving unit 34*a* open and close the intake valve 32 and the exhaust valve 34, respectively, in response to signals from the driving circuit 39.

Figure 10:
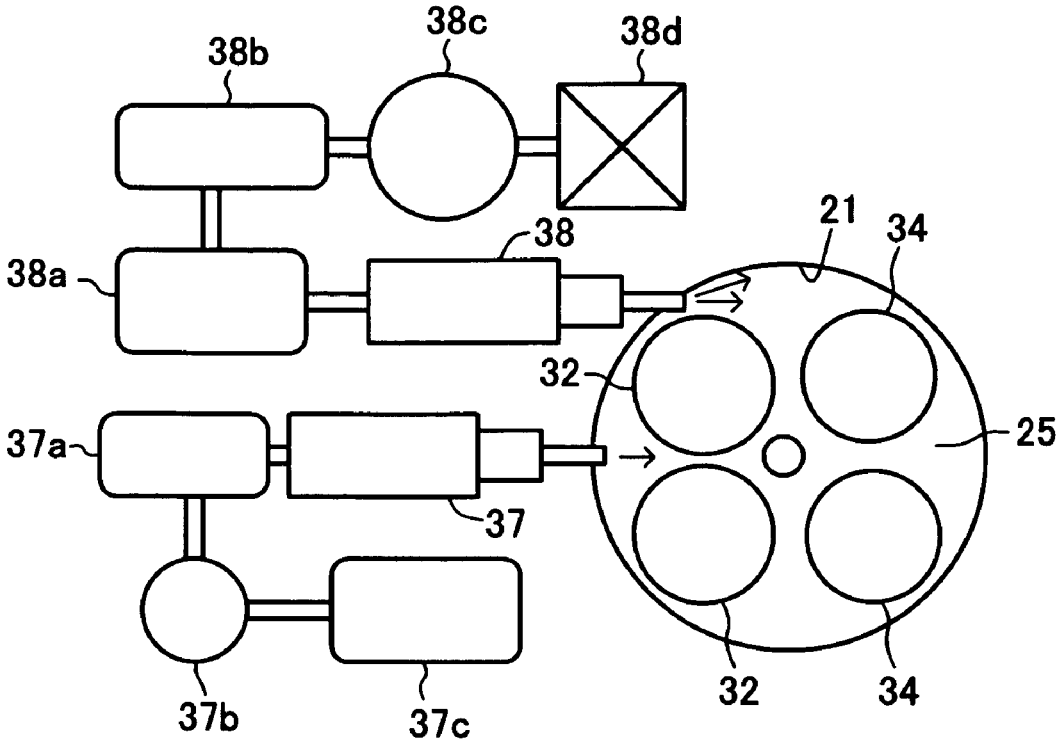
FIG. 10 is a schematic configuration diagram of means for injecting fuel shown in FIG. 9 and means for injecting high pressure air shown in FIG. 9.

The injector 37 is communicated with an accumulator 37*a*, a fuel pump 37*b*, and a fuel tank shown in FIG. 10, in this order. The fuel pump 37*b* supplies the accumulator 37*a* with the fuel with pressurizing the fuel in the fuel tank 37*c* in response to a driving signal. The accumulator 37*a* accumulates the high-pressure fuel. With above configurations, the injector 37 injects the high-pressure fuel into the combustion chamber 25 when it is opened in response to a driving signal. Note that, these constitute fuel injection means.

The air injection valve 38, as shown in FIG. 10, is communicated with an air accumulation tank 38*a*, a heat exchange unit (or a cooling unit) 38*b*, an air compressor (a air compressing pump) 38*c*, and an air cleaner 38*d*, in this order. The air compressor 38*c* compresses air introduced through the air cleaner 38*d* in response to a driving signal, and then supplies the heat exchange unit 38*b* with the compressed air. The heat exchange unit 38*b* cools the compressed air to supply the air accumulation tank 38*a* with the cooled compressed air. The air accumulation tank 38*a* accumulates the cooled compressed air. The air injection valve 38 is exposed to the combustion chamber 25 and is disposed such that it injects the compressed air in a tangential direction of the cylinder bore of the cylinder 21. With the arrangements above, the air injection valve 38 injects the high-pressure and low temperature air into the combustion chamber 25 along the tangential direction of the cylinder bore, when opened in response to a driving signal. Note that, these constitute air injection means serving as high-pressure fluid injection means.

Referring back to FIG. 9, the intake system 40 includes an intake manifold 41, communicating with the intake port 31, which constitutes the intake passage (or charging passage) together with the intake port 31; a surge tank 42 communicating with the intake manifold 41, an intake duct (or charge duct) 43 whose one end of both ends is connected to the surge tank 42, an air filter 44, a compressor 91*a* of a turbocharger 91, a bypass flow control valve 45, an intercooler 46 and a throttle valve 47, disposed at the intake duct 43 in this order from the other end of the intake duct 43 toward the downstream end (i.e., the intake manifold 41).

The intake system 40 further includes a bypass passage 48. One end of the bypass passage 48 is connected with the bypass flow control valve 45, and the other end of the bypass passage 48 is connected with the intake duct 43 at a position between the intercooler 46 and the throttle valve 47. The bypass flow control valve 45 is configured so as to control an amount of air introduced into or bypassing the intercooler 46 (i.e., an amount of air introduced into the bypass passage 48).

The intercooler 46 is a water-cooled type to cool the air passing through the intake duct 43. The intercooler 46 is connected with a radiator 46*a* which emits heat of the cooling water in the intercooler 46 into the atmosphere, and with a circulating pump 46*b* which circulates the cooling water between the intercooler 46 and the radiator 46*a*.

The throttle valve 47 is supported rotatively within the intake duct 43 by the intake duct 43. The throttle valve 47 is connected with a throttle valve actuator 47*a* serving as means for driving throttle valve. The throttle valve 47 is rotatively driven by the throttle valve actuator 47*a* to vary the cross-sectional opening area of the intake duct 43.

The exhaust system 50 includes an exhaust pipe 51 including exhaust manifolds communicating with the exhaust ports 33 and constituting an exhaust passage together with the exhaust ports 33; a turbine 91*b* of the turbocharger 91 disposed in the exhaust pipe 51; a waste gate passage 52 connected with the exhaust pipe 51 at a upstream position and a downstream position of the turbine 91*b* so as to bypass the turbine 91*b*; a charging pressure control valve 52*a* disposed in the waste gate passage 52; and a 3-way catalytic converter 53 disposed in the exhaust pipe 51 at a position downstream of the turbine 91*b*.

With the arrangements described above, the turbocharger 91 charges air into the internal combustion engine 10. The pressure control valve 52*a* controls an amount of the exhaust gas introduced into the turbine 91*b* in response to a driving signal, and thereby to control pressure (charging pressure) in the intake passage. Note that, the charging pressure is controlled by the pressure control valve 52*a* and the like so as to agrees to a target charging pressure determined based on a load of the internal combustion engine 10 (e.g., a travel of an accelerator pedal Accp) and an engine rotational speed NE.

Meanwhile, this system includes an air flowmeter 61; a crank position sensor 62; a combustion pressure sensor 63; and an accelerator opening sensor 64. The air flowmeter 61 outputs a signal indicative of an amount of intake air Ga. The crank position sensor 62 outputs a signal that assumes the form of a narrow pulse every minute rotation of the crankshaft 24 and assumes the form of a wide pulse every 360° rotation of the crankshaft 24. This signal indicates the engine speed NE and the crank angle CA. The combustion pressure sensor 63 outputs a signal indicative of pressure Pa (or combustion pressure Pa) in the combustion chamber 25. The accelerator opening sensor 64 outputs a signal indicative of the travel Accp of an accelerator pedal operated by a driver.

An electric control device 70 is a microcomputer, which includes the following mutually bus-connected elements: a CPU 71; a ROM 72 in which programs to be executed by the CPU 71, tables (look-up tables, maps), constants, and the like are stored in advance; a RAM 73 in which the CPU 71 stores data temporarily as needed; a backup RAM 74, which stores data while power is held on and which retains the stored data even while power is held off; and an interface 75 including an AD converter.

The interface 75 is connected to the sensors 61 to 64. Signals from the sensors 61 to 64 are supplied to the CPU 71 through the interface 75. The interface 75 is connected to the fuel pump 37*b*, the air injection valve 38, the air compressor 38*c*, the driving circuit 39, the bypass flow control valve 45, the throttle valve actuator 47*a*, and the charging pressure control valve 52*a*. Driving signals from the CPU 71 are sent, through the interface 75, to them.

Figure 11:
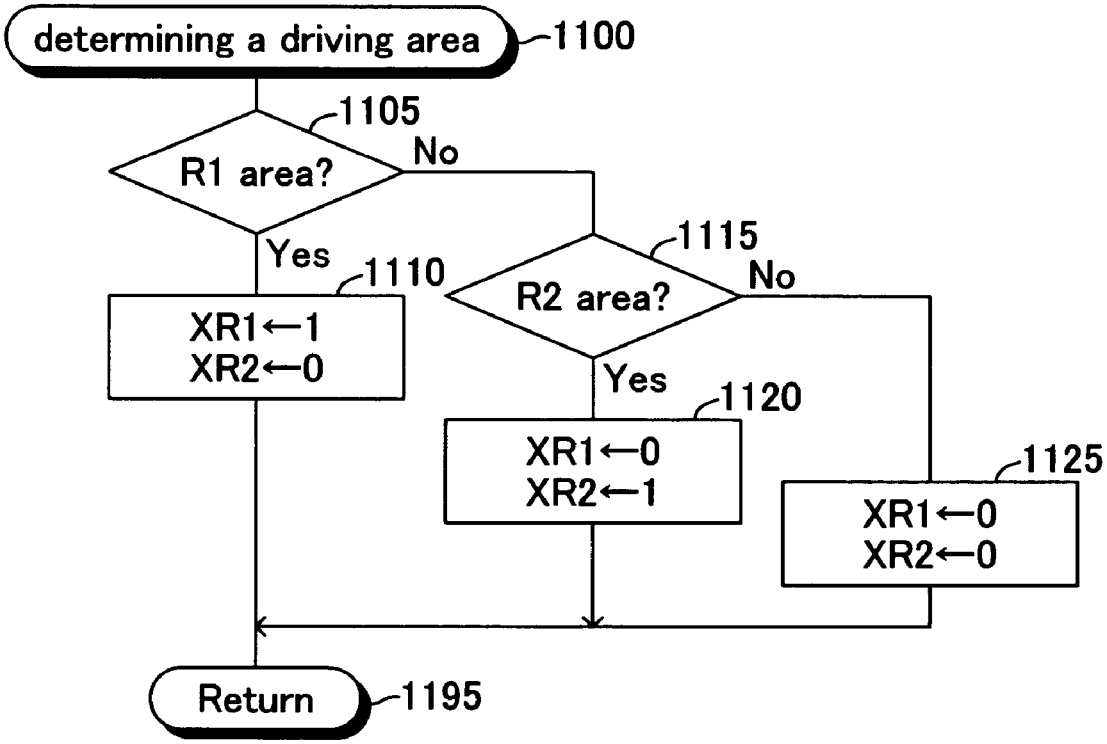
FIG. 11 is a flowchart showing a routine for determining a driving area (condition) that the CPU shown in FIG. 9 executes.

Next will be described the operation of the thus-configured control apparatus for the internal combustion engine. The CPU 71 of the electric control device 70 executes, every elapse of a predetermined time, a routine for determining a driving area (condition) as represented by the flowchart of FIG. 11.

Figure 12:
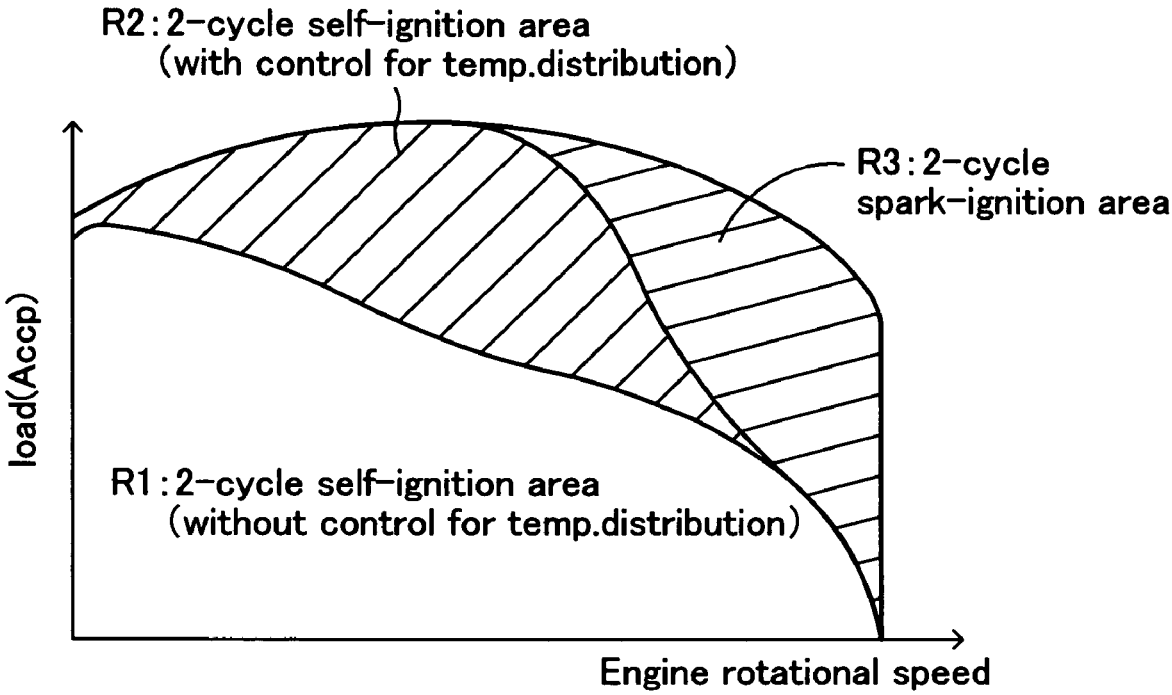
FIG. 12 is a table (map) specifying the driving areas (operating areas), the table being referenced by the CPU shown in FIG. 9 when it executes the routine shown in FIG. 11.

When predetermined timing is reached, the CPU 71 starts processing from step 1100 and proceeds to step 1105, in which the CPU 71 determines whether or not the driving condition of the engine 10 is in a 2-cycle self-ignition area R1 (pre-mixed charge compression ignition combustion area R1) based on the current load (e.g., the travel of an accelerator pedal Accp), the current engine rotational speed NE, and the area determining map shown in FIG. 12.

As shown in FIG. 12, the self-ignition area comprises 2-cycle self-ignition area R1 (where no control for the temperature distribution of the air-fuel mixture gas is performed) and the 2-cycle self-ignition area R2 (where control for the temperature distribution of the air-fuel mixture gas is performed). The 2-cycle self-ignition area R1 includes a light load area and a middle load area within the 2-cycle self-ignition area. The 2-cycle self-ignition area R2 includes a high load area within the 2-cycle self-ignition area. A 2-cycle spark-ignition area R3 is an area where the load and the engine rotational speed are higher (or larger) than those in the 2-cycle self-ignition area.

Assuming that the current driving condition of the internal combustion engine is in the 2-cycle self-ignition area R1, the CPU 71 forms the "Yes" judgment in step 1105 and proceeds to step 1110 to set the value of the flag XR1 at "1" and set the value of the flag XR2 at "0". Thereafter, the CPU 71 proceeds to step 1195 to end the present routine for the present.

Figure 13:
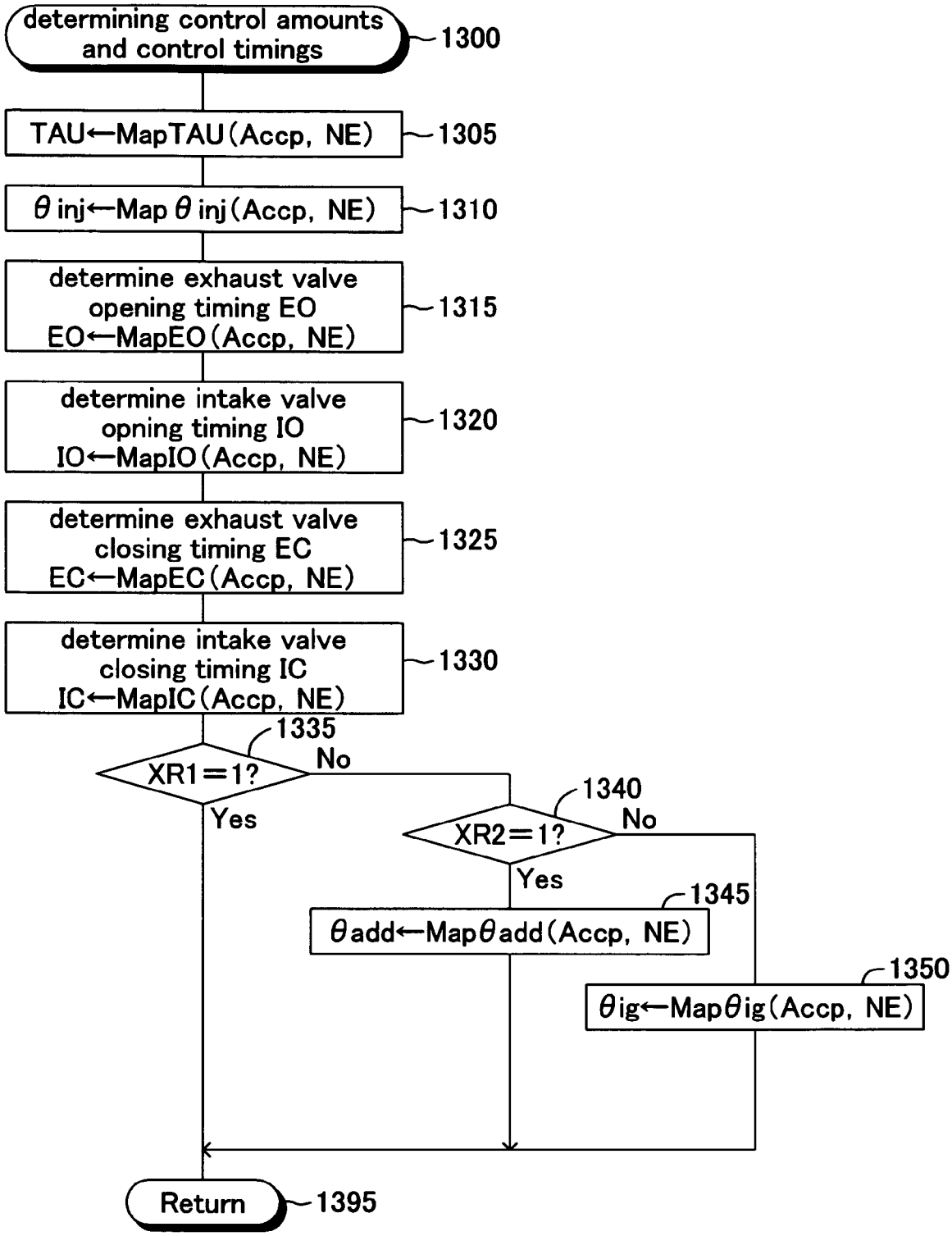
FIG. 13 is a flowchart showing a routine, that the CPU shown in FIG. 9 executes, for determining control amounts and control timings for the engine.

Meanwhile, the CPU 71 executes a routine for determining control amounts and control timings for the engine as represented by the flowchart of FIG. 13, every time when the crank angle reaches the top dead center (or a predetermined crank angle between the top death center and 90° crank angle after the top death center).

Therefore, when the appropriate timing is reached, the CPU 71 starts processing from step 1300 and proceeds to step 1305, in which the CPU 71 determines a fuel injection amount TAU (or an amount of fuel to be injected TAU) (TAU=MapTAU(Accp, NE)) based on the current travel of an accelerator pedal Accp, the current engine rotational speed NE, and a table that specify the relationships among the fuel injection amount TAU, the travel of an accelerator pedal Accp, and the engine rotational speed NE.

Note that, in the present specification, a table expressed by MapX(a,b) is a table that specifies relationships among the value X, the parameter a, and the parameter b. Further, determining or obtaining the value X based on the table MapX(a,b) means that the value X is determined or obtained based on the current parameter a, the current parameter b, and the table MapX(a,b).

Then, the CPU 71 proceeds to step 1310 to obtain a fuel injection start timing θinj based on a table Map θinj(Accp, NE), and proceeds to step 1315 to obtain an exhaust valve opening timing EO based on a table MapEO(Accp,NE). Subsequently, the CPU 71 proceeds to step 1320 to obtain an intake valve opening timing 10 based on a table MapIO(Accp, NE), and proceeds to step 1325 to obtain an exhaust valve closing timing EC based on a table MapEC(Accp,NE).

Next, the CPU 71 proceeds to step 1330 to obtain an intake valve closing timing IC based on a table MapIC(Accp,NE), and proceeds to step 1335 to determine whether or not the value of the flag XR1 is "1". As mentioned above, the internal combustion engine 10 is currently driven under the 2-cycle self-ignition area R1, the value of the flag XR1 has been set at "1". Therefore, the CPU 71 forms the "Yes" judgment in step 1335 and proceeds to step 1395 to end the present routine for the present.

Figure 14:
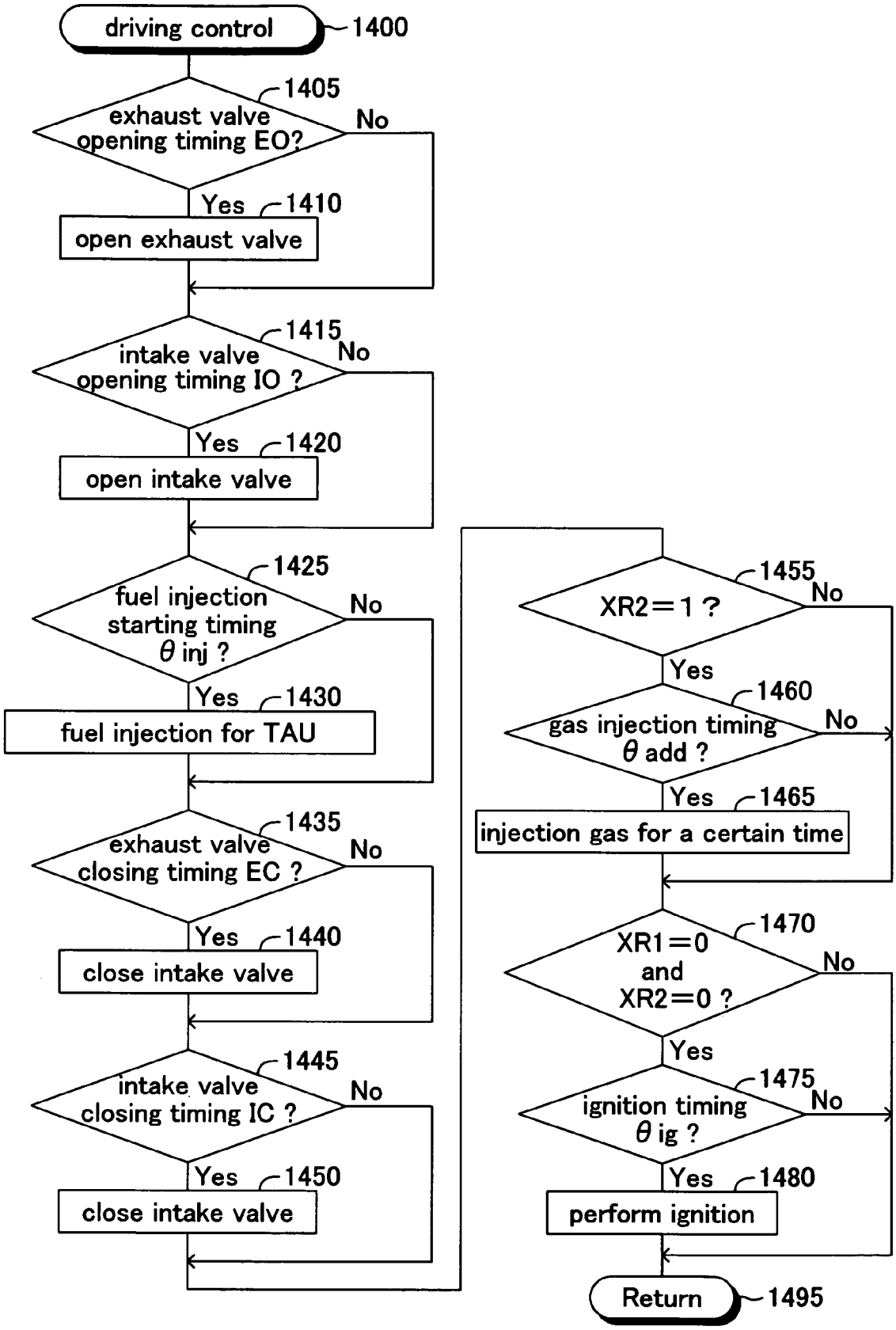
FIG. 14 is a flowchart showing a drive control routine that the CPU shown in FIG. 9 executes.

Further, the CPU 71 executes a drive control routine as represented by the flowchart of FIG. 14, every elapse of a minute crank angle. Thus, when predetermined timing is reached, the CPU 71 starts processing of the present routine from step 1400 and proceeds to step 1405, in which the CPU 71 determines whether or not the current crank angle agrees to (or reaches or coincides with) the exhaust valve closing timing EO determined at step 1315 shown in FIG. 13 described above. If the current crank angle agrees to the exhaust valve opening timing EO, the CPU 71 forms the "Yes" judgment in step 1405 and proceeds to step 1410 to send the driving signal to the driving circuit 39 for opening the exhaust valve 34. By the driving signal, the exhaust valve driving unit 34*a* operates to open the exhaust valve 34.

Subsequently, the CPU 71 generates various driving signals at appropriate timings, just as in the case of opening the exhaust valve 34, to perform various functions described below.

Step 1415 and Step 1420 . . . The CPU 71 sends the driving signal to the driving circuit 39 for opening the intake valve 32 when the crank angle agrees to the intake valve opening timing 10, so that the intake valve 32 is opened by the operation of the intake valve driving unit 32*a*.

Step 1425 and Step 1430 . . . The CPU 71 opens the injector 37 for a time period correspond to the fuel injection amount TAU when the crank angle agrees to the fuel injection start timing θinj determined at step 1310 shown in FIG. 13, thereby injects the fuel by the fuel injection amount TAU.

Step 1435 and Step 1440 . . . The CPU 71 sends the driving signal to the driving circuit 39 for closing the exhaust valve 34 when the crank angle agrees to the exhaust valve closing timing EC, so that the exhaust valve 34 is closed by the operation of the exhaust valve driving unit 34*a*.

Step 1445 and Step 1450 . . . The CPU 71 sends the driving signal to the driving circuit 39 for closing the intake valve 32 when the crank angle agrees to the intake valve closing timing IC, so that the intake valve 32 is closed by the operation of the exhaust valve driving unit 32*a*.

Next, the CPU 71 proceeds to step 1455 to determine whether or not the value of the flag XR2 is "1". In this case, the value of the flag XR2 has been set at "0" at the precedent step 1110. Therefore, the CPU 71 forms the "No" judgment in step 1455 and proceeds to step 1470 to determine both values of the flags XR1 and XR2 are set at "0". Under the current situation, since the value of the flag XR1 is set at "1", the CPU 71 forms the "No" judgment in step 1470 and proceeds to step 1495 to end the present routine for the present.

With the operation described above, as shown in FIG. 15, the exhaust valve 34 is opened at the exhaust opening timing EO to start the exhaust period (exhaust stroke), so that the high temperature combustion gas begins to be emitted or displaced from the combustion chamber 25 through the exhaust port 33. Subsequently, the intake valve 32 is opened at the intake opening timing 10 to start the scavenging period (scavenging stroke). During the scavenging period, low temperature air (fresh air) is introduced into the combustion chamber 25 through the intake port 31, and the high temperature combustion gas is emitted from the combustion chamber 25 to the exhaust port 33 by the introduction of the air.

Thereafter, the fuel is injected at the fuel injection starting timing θinj which is an appropriate timing in the vicinity of the bottom dead center, so that air-fuel mixture gas including the combustion gas, the air, and the fuel begins to be formed in the combustion chamber 25. Next, the exhaust valve 34 is closed at the exhaust closing timing EC to complete the scavenging period and to start the charging period (or intake period, charging stroke) in which more air is introduced into the combustion chamber 25. Then, the intake valve 32 is closed at the intake valve closing timing IC to complete the intake stroke (charging stroke). Thereafter, the air-fuel mixture self-ignites (ignites spontaneously) to start the expansion stroke when the crank angle reaches in the vicinity of the top dead center (TDC). Note that no high pressure air injection described later is performed and no spark ignition is carried out, because the driving condition of the internal combustion engine is in the 2-cycle self-ignition area R1.

Hereinafter, the description is made based on the assumption that the current driving condition of the internal combustion engine is shifted to the 2-cycle self-ignition area R2 (where control for the temperature distribution of the air-fuel mixture gas is performed). It can be said that the current driving condition of the engine is in the 2-cycle self-ignition area R2 means that the driving condition is within the self-ignition area (total area of the area R1 and the area R2) and the load of the engine is larger (or higher) than a (first) predetermined high load threshold.

Under this condition, the CPU 71 forms the "No" judgment in step 1105 shown in FIG. 11 and proceeds to step 1115 to determine whether or not the driving condition of the engine 10 is in the 2-cycle self-ignition area R2 (pre-mixed charge compression ignition combustion area R2) based on the current load, the current engine rotational speed NE, and the area determining map shown in FIG. 12. Then, the CPU 71 forms the "Yes" judgment in step 1115 and proceeds to step 1120 to set the value of the flag XR1 at "0" and set the value of the flag XR2 at "1". Thereafter, the CPU 71 proceeds to step 1195 to end the present routine for the present.

At this time, when the CPU 71 starts processing from step 1300 shown in FIG. 13, the CPU 71 executes from step 1305 to step 1330, and proceeds to step 1335. Thereafter, the CPU 71 forms the "No" judgment in step 1335 and proceeds to step 1340 to determine whether or not the value of the flag XR2 is "1". In this case, the values of the flag XR2 is "1". Thus, the CPU 71 forms the "Yes" judgment in step 1340 and proceeds to step 1345 to determine a gas injection start timing θadd (an air injection timing in the present embodiment) based on a table Map θadd(Accp, NE). Thereafter, the CPU 71 proceeds to step 1395 to end the present routine for the present. The table Map θadd(Accp, NE) is set (predetermined) in such a manner that the gas injection start timing θadd exists within the middle phase of the compression stroke.

Thereafter, when the CPU 71 executes the routine shown in FIG. 14, the CPU 71 performs opening and closing control for the exhaust valve 34 and the intake valve 32 and the like through processing steps from step 1405 to step 1450. Also, in this case, the value of flag XR2 has been set at "1". Thus, the CPU 71 forms the "Yes" judgment in step 1455 and proceeds to step 1460 and step 1465 to open the air injection valve 38 for a predetermined time period when the crank angle reaches the gas injection start timing θadd (an air injection timing θadd) determined at step 1345. Meanwhile, the CPU 71 forms the "No" judgment in step 1470 when it proceeds to step 1470, and proceeds to step 1495 to end the present routine for the present.

Figure 15:
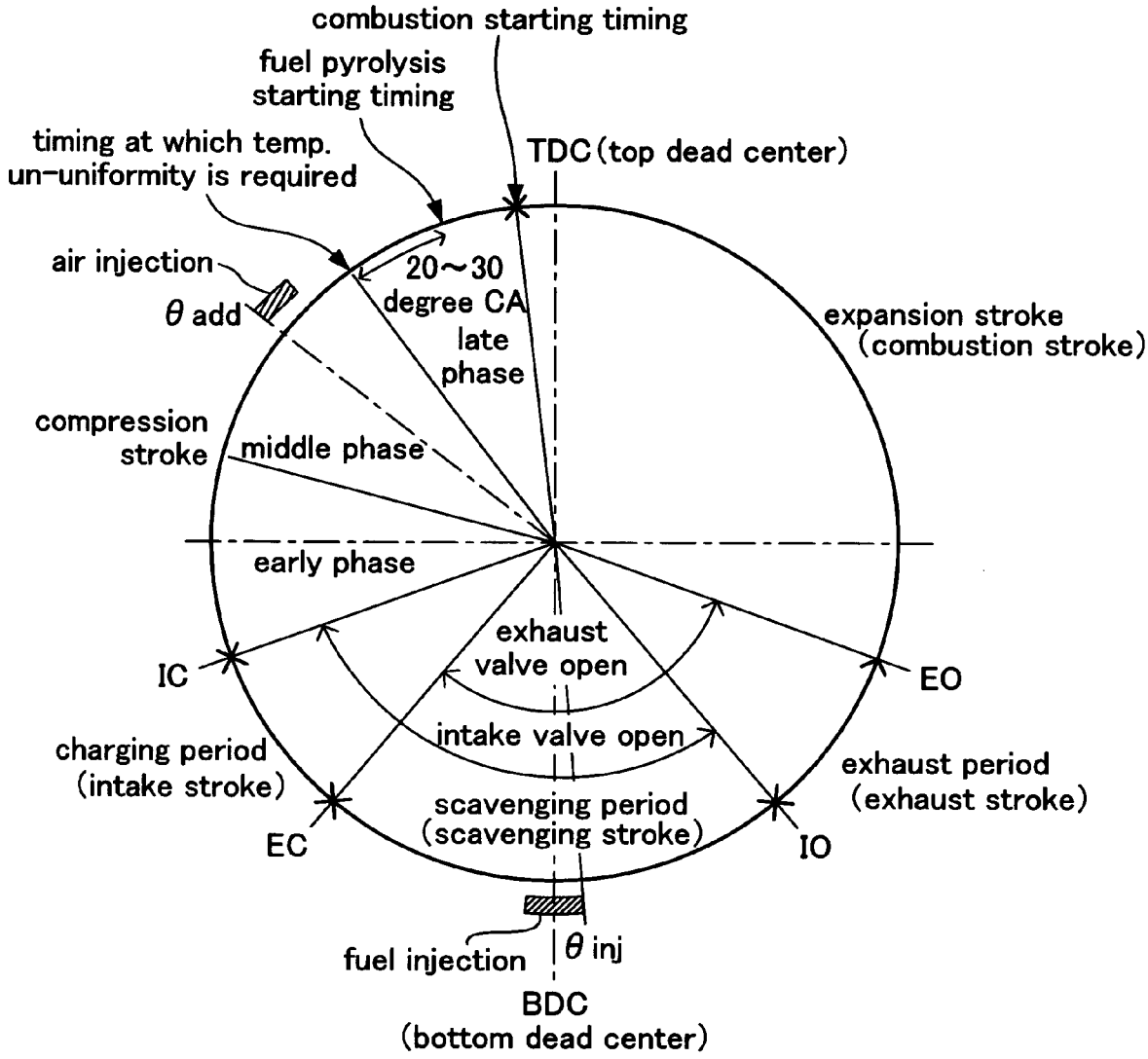
FIG. 15 is an explanation drawing schematically showing valve timings, a fuel injection timing, an air injection timing, and the like for the internal combustion engine shown in FIG. 9.

As described above, if the driving condition of the internal combustion engine is in the 2-cycle self-ignition area R2 (i.e., the value of the flag XR2 is set at "1"), the low temperature and high pressure air is injected in the tangential direction of the cylinder bore during at least the middle phase of the compression stroke, when the crank angle reaches the gas injection start timing θadd, as shown in FIG. 15. Thus, the temperature un-uniformity of the air-fuel mixture gas is enhanced at the above described timing, because the low temperature and high pressure air is injected into the relatively high temperature air-fuel mixture gas in the combustion chamber 25.

As explained above, the temperature un-uniformity formed at this timing (i.e., during middle phase of the compression stroke) can last till the fuel pyrolysis starting timing in the late phase of the compression stroke (i.e. the timing at which concentration of the fuel reaches 90% of the initial concentration of the fuel, or at which 10% of the fuel is pyrolyzed). As a result, the un-uniformity of the air-fuel mixture at the fuel pyrolysis starting timing is larger than un-uniformity of the air-fuel mixture formed on by being simply compressed only during the compression stroke without high pressure air injection. Therefore, the self-ignition and the combustion takes place moderately, and the combustion period (time duration) is lengthen. Thus, the pressure rising rate does not become excessive, and the noise (combustion noise) is reduced (the noise becomes small).

Hereinafter, the description is made based on the assumption that the current driving condition of the internal combustion engine is shifted to the 2-cycle spark-ignition area R3.

Under this condition, the CPU 71 forms the "No" judgments in step 1105 and in step 1115 shown in FIG. 11 to proceeds to step 1125 to set both the values of the flag XR1 and the flag XR2 at "0". Thereafter, the CPU 71 proceeds to step 1195 to end the present routine for the present.

At this time, when the CPU 71 starts processing from step 1300 shown in FIG. 13, the CPU 71 executes from step 1305 to step 1330, forms the "No" judgment in both step 1335 and step 1340, and proceeds to step 1350. The CPU 71 determines a spark ignition timing θig based on a table Map θig(Accp, NE), and proceeds to step 1395 to end the present routine for the present.

Thereafter, when the CPU 71 executes the routine shown in FIG. 14, the CPU 71 performs opening and closing control for the exhaust valve 34 and the intake valve 32 and the like through processing steps from step 1405 to step 1450. Also, in this case, both of the values of flag XR1 and flag XR2 has been set at "0". Thus, the CPU 71 forms the "No" judgment in step 1455 and directly proceeds to step 1470 to form the "Yes" judgment in step 1470. As a result, the CPU 71 sends the driving signal (spark ignition control signal) to the igniter 36 through step 1475 and step 1480, when the crank angle reaches the spark ignition timing θig. Thus, the spark ignition for the air-fuel mixture gas is carried out by the spark plug 35.

As described above, the low temperature and high pressure air (high pressure fluid) is injected from the air injection valve 38 into the combustion chamber 25 during the middle phase of the compression stroke by the control apparatus according to the first embodiment of the present invention. Thus, the temperature un-uniformity of the air-fuel mixture gas is enhanced at the timing of 20 to 30° crank angle prior to the fuel pyrolysis starting timing at the latest. Further, the temperature un-uniformity formed at the above timing can last till the fuel pyrolysis starting timing. In addition, mixing of the air and the air-fuel mixture gas (or fuel) progresses for the time period corresponding to 20 to 30° crank angle from the air injection timing. Thus, the air-fuel mixture gas at the fuel pyrolysis starting timing has the temperature un-uniformity which is significant and large in moderating the combustion. Accordingly, the combustion becomes moderated and the combustion period is lengthened. As a result, it is avoided that the pressure rising rate becomes excessive, and therefore, the noise (combustion noise) is reduced.

Moreover, in the first embodiment, the swirl flow is generated in the combustion chamber 25, because the low temperature and high pressure air is injected into the combustion chamber 25 along the tangential direction of the cylinder bore. Thus, the heat transfer is enhanced (or is promoted) between the air-fuel mixture gas and the wall of the cylinder 21 whose temperature is lower than the air-fuel mixture gas to increase a heat transfer coefficient of the wall of the cylinder 21. As a result, the temperature un-uniformity of the air-fuel mixture gas is formed more effectively.

Furthermore, in the first embodiment, the high pressure air is injected into the air-fuel mixture gas in the combustion chamber 25 whose pressure is lower than the injected air. Therefore, the temperature of the injected air decreases due to the effect of the adiabatic expansion. As a result, it is possible to provide the air-fuel mixture gas with the temperature un-uniformity more effectively.

Meanwhile, a lower temperature portion is formed so as to have a ring-like shape in the vicinity of the bottom wall of the cylinder 21 by such air injection described above. On the other hand, temperature of the air-fuel mixture gas existing in the central area of the combustion chamber 25 does not reduce, and therefore, self-ignitability of the air-fuel mixture gas existing in the central area of the combustion chamber 25 does not change greatly compared to the case where no air injection is performed. Accordingly, it is easily accomplished to lengthen the combustion period without varying the self-ignition timing.

Second Embodiment

A control apparatus for the internal combustion engine according to the second embodiment of the present invention will be described. The control apparatus according to the second embodiment differs from the first embodiment in that the second embodiment injects into the combustion chamber 25 high pressure hydrogen gas (or high pressure carbon monoxide gas) as the high pressure fluid, instead of the high pressure air. Thus, hereinafter, the description is made by focusing on this difference.

Figure 16:
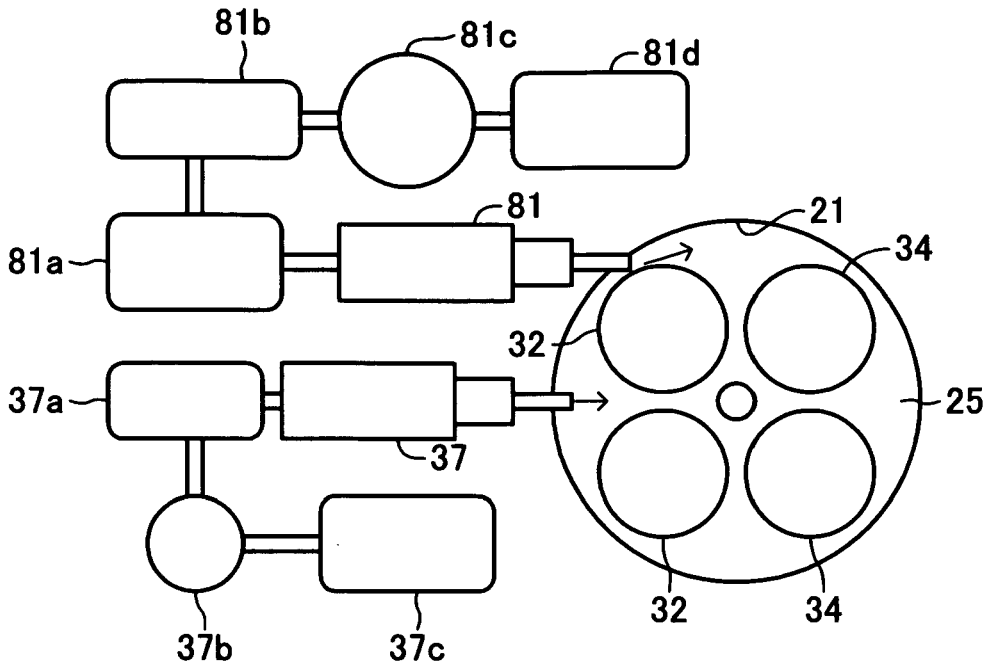
FIG. 16 is a schematic configuration diagram of means for injecting fuel and means for injecting high pressure gas (hydrogen gas) of the second embodiment of the present invention.

This control apparatus, as shown in FIG. 16, comprises a gas injection valve 81 in place of the air injection valve 38. The gas injection valve 81 is communicated with a gas accumulation tank 81*a*, a heat exchange unit 81*b*, a gas compressor (a gas compressing pump) 81*c*, and a gas tank 81*d*, in this order. The gas compressor 81*c* compresses hydrogen gas in the gas tank 81*d* in response to a driving signal, and then supplies the heat exchange unit 81*b* with the compressed hydrogen gas. The heat exchange unit 81*b* cools the compressed hydrogen gas to supply the gas accumulation tank 81*a* with the cooled compressed hydrogen gas. The gas accumulation tank 81*a* accumulates the cooled compressed hydrogen gas. The gas injection valve 81 is exposed to the combustion chamber 25 and is disposed such that it injects the compressed hydrogen gas in a tangential direction of the cylinder bore of the cylinder 21.

With the arrangements above, the gas injection valve 81 injects the high pressure and low temperature hydrogen gas into the combustion chamber 25 along the tangential direction of the cylinder bore, when opened in response to the driving signal.

An electric control device 70 of the second embodiment operates substantially in the same way as the control device 70 of the first embodiment. However, the table Map θadd (Accp,NE) used in step 1345 shown in FIG. 13 has been adapted to the hydrogen gas.

As described above, according to the control apparatus of the second embodiment, the cooled hydrogen gas is injected into the combustion chamber 25 from the gas injection valve 81 during the middle phase of the compression stroke. Thus, the hydrogen molecules exist within the air-fuel mixture gas inhomogeneously (or nonuniformly, in a spotty fashion). The hydrogen molecules cause the temperature un-uniformity of the air-fuel mixture gas to be enhanced at the timing of 20 to 30° crank angle prior to the fuel pyrolysis starting timing at the latest.

The temperature un-uniformity formed at this timing (i.e., during middle phase of the compression stroke) can last till the fuel pyrolysis starting timing. Further, mixing of the hydrogen molecules and the air-fuel mixture gas (or fuel) progresses for the time period corresponding to 20 to 30° crank angle from the hydrogen gas injection timing. Thus, the air-fuel mixture gas at the fuel pyrolysis starting timing has the temperature un-uniformity which is significant and large in moderating the combustion. Accordingly, the combustion becomes moderated and the combustion period is lengthened. As a result, it is avoided that the pressure rising rate becomes excessive, and therefore, the noise (combustion noise) is reduced.

Further, in the second embodiment, the swirl flow is generated in the combustion chamber 25, because the low temperature and high pressure hydrogen gas is injected into the combustion chamber along the tangential direction of the cylinder bore. Thus, the heat transfer is enhanced (or is promoted) between the air-fuel mixture gas and the wall of the cylinder 21 whose temperature is lower than the air-fuel mixture gas to increase a heat transfer coefficient of the wall of the cylinder 21. As a result, the temperature un-uniformity of the air-fuel mixture gas is formed more effectively.

In addition, it is inferred that the hydrogen can suppress generation of an intermediate product which is formed while the fuel (or the gasoline) is self-ignited. Thus, the mixture gas including the hydrogen and the gasoline requires longer time in self-ignition than the gasoline (or diesel oil) which does not include the hydrogen. Therefore, according to the second embodiment, it is possible to lengthen the combustion period more effectively not only by the temperature un-uniformity of the air-fuel mixture gas but also by the un-uniformity of concentration due to existence of the hydrogen which hinders the self-ignition of the air-fuel mixture gas.

Furthermore, in the second embodiment, the high pressure hydrogen gas is injected into the air-fuel mixture gas in the combustion chamber 25 whose pressure is lower than the injected hydrogen gas. Therefore, the temperature of the injected hydrogen gas decreases due to the effect of the adiabatic expansion. As a result, it is possible to provide the air-fuel mixture gas with the temperature un-uniformity more effectively.

Meanwhile, a lower temperature portion is formed so as to have a ring-like shape in the vicinity of the bottom wall of the cylinder 21 by such hydrogen gas injection described above. On the other hand, temperature of the air-fuel mixture gas existing in the central area of the combustion chamber 25 does not reduce, and therefore, self-ignitability of the air-fuel mixture gas existing in the central area of the combustion chamber 25 does not change greatly compared to the case where no hydrogen gas injection is performed. Accordingly, it is easily accomplished to lengthen the combustion period without varying the self-ignition timing.

Furthermore, in the second embodiment, a portion where a concentration of the hydrogen is high begins self-ignition lately. Meanwhile, the hydrogen has a high reactivity once ignited. As a result, an amount of the hydro carbon HC and an amount of the carbon monoxide CO, both of which are likely to be greatly generated during the late phase of the combustion can be decreased.

It should be mentioned that the hydrogen is used in the second embodiment, however, the carbon monoxide CO may be used in place of the hydrogen to achieve the similar advantages. Note that, the hydrogen is not self-ignited easily (the self-ignitability is poor), but its combustion proceeds rapidly once ignited. To the contrary, the carbon monoxide CO has characteristics that it is as easily self-ignited as the gasoline (i.e., it has the same level of the self-ignitability as the gasoline), but that its combustion proceeds slowly after ignited. Therefore, using the carbon monoxide CO as the high pressure fluid enables the combustion period to be lengthened due to decreasing the combustion speed rather than retarding the self-ignition timing.

Third Embodiment

A control apparatus for the internal combustion engine according to the third embodiment of the present invention will be described. The control apparatus according to the third embodiment differs from the first embodiment in that the third embodiment injects into the combustion chamber 25 combustion gas (or burnt gas, EGR gas, exhausted gas) emitted from the combustion chamber 25 and thereafter compressed and cooled, serving as the high pressure fluid, instead of the high pressure air. Thus, hereinafter, the description is made by focusing on this difference.

Figure 17:
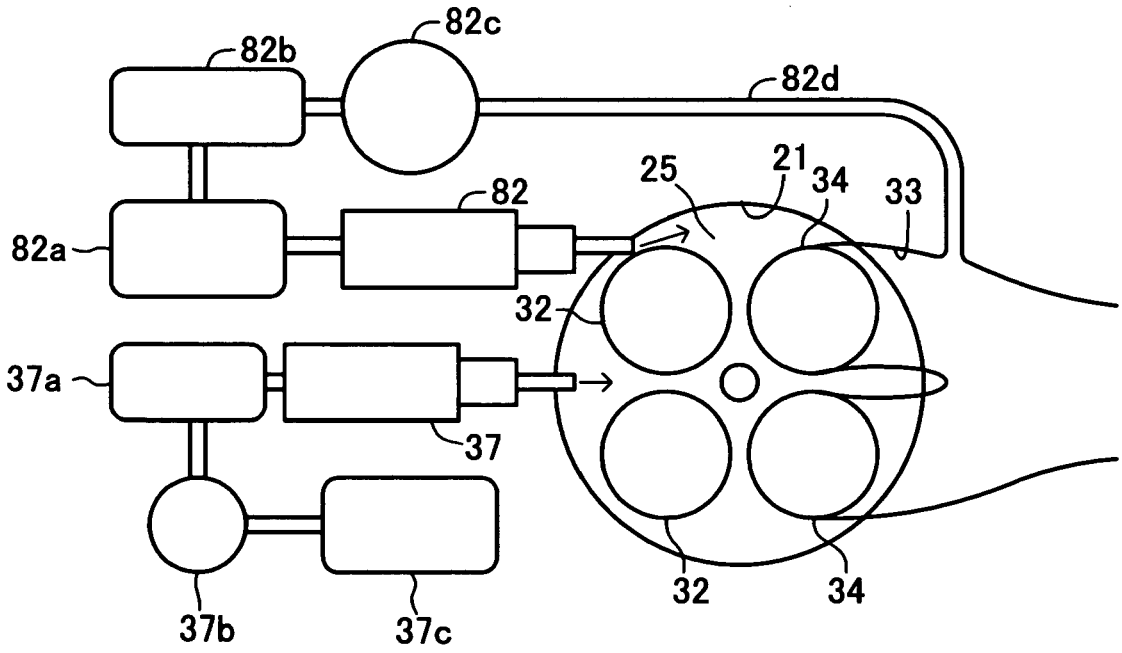
FIG. 17 is a schematic configuration diagram of means for injecting fuel and means for injecting high pressure gas (combustion gas) of the third embodiment of the present invention.

This control apparatus, as shown in FIG. 17, comprises a gas injection valve 82 in place of the air injection valve 38. The gas injection valve 82 is communicated with the exhaust port 33 through a gas accumulation tank 82*a*, a heat exchange unit 82*b*, a gas compressor (a gas compressing pump) 82*c*, and an EGR gas passage 82*d*. The gas compressor 82*c* compresses combustion gas introduced from the exhaust port 33 in response to a driving signal, and then supplies the heat exchange unit 82*b* with the compressed combustion gas. The heat exchange unit 82*b* cools the compressed combustion gas to supply the gas accumulation tank 82*a* with the cooled compressed combustion gas. The gas accumulation tank 82*a* accumulates the cooled compressed combustion gas. The gas injection valve 82 is exposed to the combustion chamber 25 and is disposed such that it injects the compressed combustion gas in a tangential direction of the cylinder bore of the cylinder 21.

With the arrangements above, the gas injection valve 82 injects the cooled high pressure combustion gas into the combustion chamber 25 along the tangential direction of the cylinder bore, when opened in response to the driving signal.

An electric control device 70 of the third embodiment operates substantially in the same way as the control device 70 of the first embodiment. However, the table Map θadd (Accp,NE) used in step 1345 shown in FIG. 13 has been adapted to the combustion gas.

According to the control apparatus for the internal combustion engine of the third embodiment, the high pressure and the low temperature combustion gas, which is taken from the exhaust port 33 (or the exhaust passage) and is compressed and cooled, is injected into the combustion chamber 25 from the gas injection valve 82 during the middle phase of the compression stroke. Thus, the temperature un-uniformity of the air-fuel mixture gas is enhanced at the timing of 20 to 30° crank angle prior to the fuel pyrolysis starting timing at the latest. Further, the temperature un-uniformity formed at the above timing can last till the fuel pyrolysis starting timing.

Furthermore, mixing of the molecules in the combustion gas and the air-fuel mixture gas (or fuel) progresses for the time period corresponding to 20 to 30° crank angle from the combustion gas injection timing. Thus, the air-fuel mixture gas at the fuel pyrolysis starting timing has the temperature un-uniformity which is significant and large in moderating the combustion. Accordingly, the combustion becomes moderated and the combustion period is lengthened. As a result, it is avoided that the pressure rising rate becomes excessive, and therefore, the noise (combustion noise) is reduced.

Moreover, in the third embodiment, the swirl flow is generated in the combustion chamber 25, because the low temperature and high pressure combustion gas is injected into the combustion chamber 25 along the tangential direction of the cylinder bore. Thus, the heat transfer is enhanced (or is promoted) between the air-fuel mixture gas and the wall of the cylinder 21 whose temperature is lower than the air-fuel mixture gas to increase a heat transfer coefficient of the wall of the cylinder 21. As a result, the temperature un-uniformity of the air-fuel mixture gas is formed more effectively.

In addition, a concentration of oxygen in the combustion gas is lower than a concentration of oxygen in the air. Thus, the self-ignition timing is delayed by injecting the combustion gas according to the third embodiment compared to by injecting the air. Specific heat of the combustion gas is larger than specific heat of the air. Therefore, by injecting the low temperature combustion gas according to the third embodiment, the temperature in a portion of the air-fuel mixture gas where concentration of the combustion gas is high increases slowly, and thus, the same portion is self-ignited later (at the later timing) than the other portion of the air-fuel mixture. Accordingly, it is possible to lengthen the combustion period more effectively not only by the temperature un-uniformity of the air-fuel mixture gas but also by the un-uniformity of concentration due to existence of the combustion gas which hinders the self-ignition of the air-fuel mixture gas.

Furthermore, in the third embodiment, the high pressure combustion gas is injected into the air-fuel mixture gas in the combustion chamber 25 whose pressure is lower than the injected combustion gas. Therefore, the temperature of the injected combustion gas decreases due to the effect of the adiabatic expansion. As a result, it is possible to provide the air-fuel mixture gas with the temperature un-uniformity more effectively.

Meanwhile, a lower temperature portion is formed so as to have a ring-like shape in the vicinity of the bottom wall of the cylinder 21 by such combustion gas injection described above. On the other hand, temperature of the air-fuel mixture gas existing in the central area of the combustion chamber 25 does not reduce, and therefore, self-ignitability of the air-fuel mixture gas existing in the central area of the combustion chamber 25 does not change greatly compared to the case where no combustion gas injection is performed. Accordingly, it is easily accomplished to lengthen the combustion period without varying the self-ignition timing.

Since the combustion gas is injected into the combustion chamber 25 in the third embodiment, no gas to be injected into the combustion chamber 25 (other than the combustion gas) is required. Therefore, the entire system can be simplified since a gas accumulation tank for store the gas and the like is not necessary.

Fourth Embodiment

A control apparatus for the internal combustion engine according to the fourth embodiment of the present invention will be described. The control apparatus according to the fourth embodiment differs from the first embodiment in that the fourth embodiment injects into the combustion chamber 25 high pressure water serving as the high pressure fluid, instead of the high pressure air, when the driving condition of the engine is in the 2-cycle self-ignition area R2, and differs from the first embodiment in that the fourth embodiment injects the high pressure water, when the driving condition of the engine is in the 2-cycle spark-ignition area R3 as well. Thus, hereinafter, the description is made by focusing on this difference.

Figure 18:
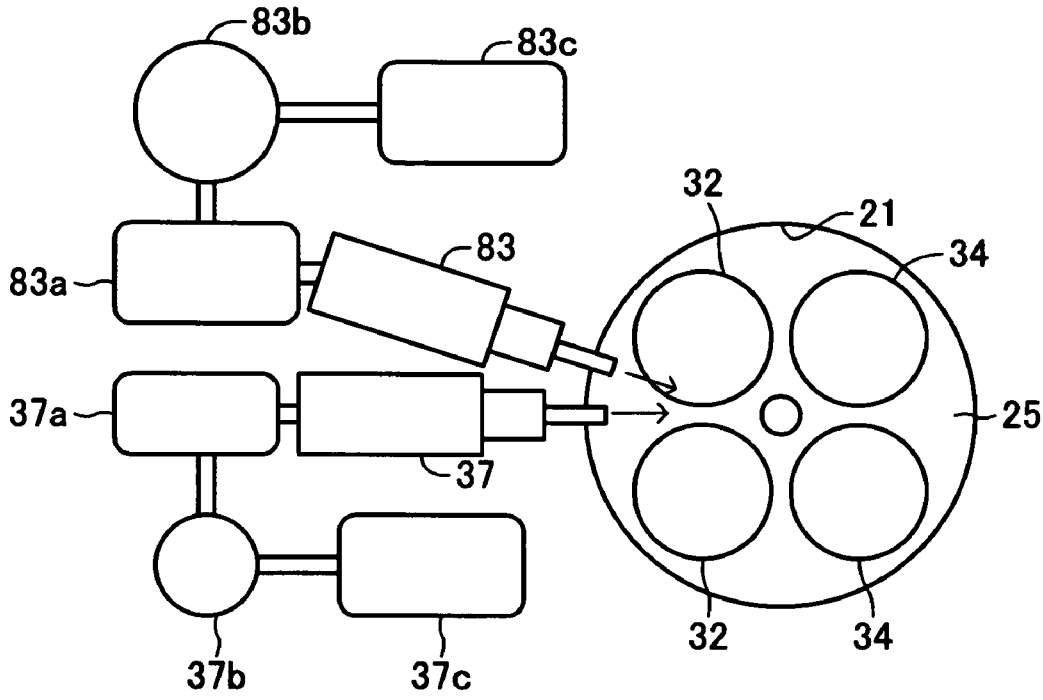
FIG. 18 is a schematic configuration diagram of means for injecting fuel and means for injecting high pressure water of the fourth embodiment of the present invention.

This control apparatus, as shown in FIG. 18, comprises a water injection valve 83 in place of the air injection valve 38. The water injection valve 83 is communicated with an accumulation tank 83*a*, a water pump 83*b*, and a water tank 83*c*, in this order. The water pump 83*b* compresses the water in the water tank 83*c* in response to a driving signal, and then supplies the accumulation tank 83*a* with the compressed water. The accumulation tank 83*a* accumulates the high pressure (or compressed) water. The water injection valve 83 is exposed to the combustion chamber 25 and is disposed such that it injects the high pressure water toward the central area of the combustion chamber 25.

With the arrangements above, the water injection valve 83 injects the high pressure water toward the central area of the combustion chamber 25, when opened in response to the driving signal. Note that the water injection valve 83 may be configured in such a manner that it injects the high pressure water into the combustion chamber 25 along a tangential direction of the cylinder bore, if water film formed on the cylinder wall causes no problem.

An electric control device 70 of the fourth embodiment operates substantially in the same way as the control device 70 of the first embodiment. However, the table Map θadd (Accp,NE) used in step 1345 shown in FIG. 13 has been adapted to the high pressure water. Further, the step 1345 shown in FIG. 13, step 1460 and step 1465 shown in FIG. 14 are replaced by steps suitable for the high pressure water injection. These steps constitute a part of high pressure water injection control means (or high pressure fluid injection control means).

Further, the electric control device 70 of the fourth embodiment is configured in such a manner that it injects the high pressure water in a period from the scavenging stroke to the intake stroke, when the driving condition of the internal combustion engine is in the 2-cycle spark-ignition area R3 (i.e., the load of the engine is larger (or larger) than a second predetermined high load threshold. That is, if the engine is operated in the 2-cycle spark-ignition area R3 which is an area of a high load driving area higher than a predetermined high load, the CPU 71 determines a water injection start timing θaddk based on a table Map θaddk(Accp, NE) and injects the high pressure water from the water injection valve 83 for a predetermined time period when the crank angle agrees to the water injection start timing θaddk. This function constitutes a part of function of the high pressure water injection control means (or the high pressure fluid injection control means).

According to the control apparatus of the fourth embodiment, the high pressure water is injected into the combustion chamber 25 from the water injection valve 83 when the driving condition of the internal combustion engine is in the 2-cycle self-ignition area R2 (i.e., the driving condition of the internal combustion engine is within the self-ignition area (total area of the area R1 and the area R2) and the load of the engine is higher than the (first) predetermined high load threshold). Thus, the air-fuel mixture gas is partially cooled by large latent heat and specific heat of the injected water. As a result, the temperature un-uniformity of the air-fuel mixture gas is enhanced at the timing of 20 to 30° crank angle prior to the fuel pyrolysis starting timing at the latest. Further, the temperature un-uniformity formed at the above timing can last till the fuel pyrolysis starting timing. In addition, mixing of the water and the air-fuel mixture gas (or fuel) progresses for the time period corresponding to 20 to 30° crank angle from the high pressure water injection timing. Thus, the air-fuel mixture gas at the fuel pyrolysis starting timing has the temperature un-uniformity which is significant and large in moderating the combustion. Accordingly, the combustion becomes moderated and the combustion period is lengthened. As a result, it is avoided that the pressure rising rate becomes excessive, and therefore, the noise (combustion noise) is reduced.

Furthermore, in the fourth embodiment, the high pressure water is injected for the period from the scavenging stroke to the intake stroke (including the scavenging stroke only, the intake stroke only, in both the scavenging stroke and the intake stroke, or up to the compression stroke start timing) if the internal combustion engine is operated in the 2-cycle spark-ignition area R3 (i.e., the high load area where the load of the engine is higher than a second predetermined high load threshold). Therefore, the air-fuel mixture gas is cooled by the turbulent flow occurring in the beginning of the compression stroke. As a result, air-filling (air-charge) efficiency is improved and knocking is controlled. This function is also a part of the high pressure water injection control means (or the high pressure fluid injection control means).

In addition, the water can be compressed by the water pump 83*b* easily since water is incompressible fluid. Thus, because work for pumping of the water pump 83*b* is small compared to the case where compressible fluid composed of gas such as air is compressed. As a result, the fuel efficiency is improved.

Fifth Embodiment

A control apparatus for the internal combustion engine according to the fifth embodiment of the present invention will be described. The control apparatus according to the fifth embodiment differs from the fourth embodiment in that the fifth embodiment injects into the combustion chamber 25 high pressure liquid fuel which is harder to be self-ignited than the gasoline instead of high pressure water injected by the forth embodiment, the high pressure liquid fuel serving as the high pressure fluid and being alcohol such as methanol and the like or being mixture of alcohol and water. Thus, hereinafter, the description is made by focusing on this difference.

Figure 19:
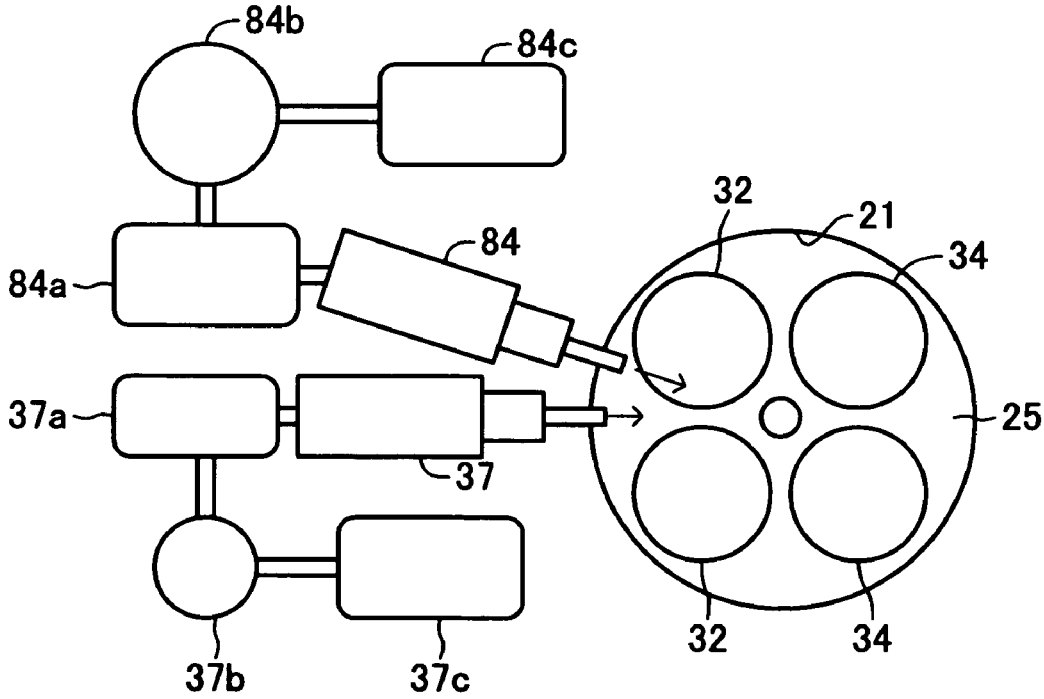
FIG. 19 is a schematic configuration diagram of means for injecting fuel and means for injecting high pressure liquid fuel of the fifth embodiment of the present invention.

This control apparatus, as shown in FIG. 19, comprises an alcohol injection valve 84 in place of the water injection valve 83. The alcohol injection valve 84 is communicated with an accumulation tank 84*a*, an alcohol pump 84*b*, and an alcohol tank 84*c*, in this order. The alcohol pump 84*b* compresses the alcohol in the alcohol tank 84*c* in response to a driving signal, and then supplies the accumulation tank 84*a* with the compressed alcohol. The accumulation tank 84*a* accumulates the high pressure (or compressed) alcohol. The alcohol injection valve 84 is exposed to the combustion chamber 25 and is disposed such that it injects the high pressure alcohol toward the central area of the combustion chamber 25.

With the arrangements above, the alcohol injection valve 84 injects the high pressure alcohol toward the central area of the combustion chamber 25, when opened in response to the driving signal. Note that the alcohol injection valve 84 may be configured in such a manner that it injects the high pressure alcohol into the combustion chamber 25 along a tangential direction of the cylinder bore, if alcohol film formed on the cylinder wall causes no problem.

According to the control apparatus of the fifth embodiment, the high pressure alcohol is injected into the combustion chamber 25 from the alcohol injection valve 84 when the driving condition of the internal combustion engine is in the 2-cycle self-ignition area R2, by the high pressure liquid fuel injection control means (or high pressure fluid injection control means) which is in place of the high pressure water injection control means of the fourth embodiment during a certain period after the start timing of the compression stroke (i.e., a timing within the middle phase of the compression stroke). Thus, the air-fuel mixture gas is partially cooled by large latent heat and specific heat of the injected alcohol. As a result, the temperature un-uniformity of the air-fuel mixture gas is enhanced at the timing of 20 to 30° crank angle prior to the fuel pyrolysis starting timing at the latest. Further, the temperature un-uniformity formed at the above timing can last till the fuel pyrolysis starting timing.

In addition, mixing of the alcohol (liquid fuel) and the air-fuel mixture gas (or fuel) progresses for the time period corresponding to 20 to 30° crank angle from the high pressure alcohol injection timing. Thus, the air-fuel mixture gas at the fuel pyrolysis starting timing has the temperature un-uniformity which is significant and large in moderating the combustion. Accordingly, the combustion becomes moderated and the combustion period is lengthened. As a result, it is avoided that the pressure rising rate becomes excessive, and therefore, the noise (combustion noise) is reduced.

Furthermore, the alcohol does not tend to be self-ignited more easily than the gasoline (the alcohol is harder to be self-ignited than the gasoline). Thus, the air-gasoline (or diesel oil) fuel mixture gas which includes the alcohol requires longer time in self-ignition than the air-gasoline fuel gas which does not include alcohol. As a result, according to the fifth embodiment, it is possible to lengthen the combustion period more effectively not only by the temperature un-uniformity of the air-fuel mixture gas but also by the un-uniformity of concentration due to existence of the alcohol which delays the self-ignition of the air-fuel mixture gas in the air-fuel mixture gas.

In addition, in the fifth embodiment, the high pressure liquid fuel injection control means injects the alcohol for the period from the scavenging stroke to the intake stroke (or up to the compression stroke start timing) if the internal combustion engine is operated in the 2-cycle spark-ignition area R3 (i.e., the high load area where the load of the engine is higher than the second predetermined high load threshold). Therefore, the air-fuel mixture gas is cooled by the turbulent flow occurring in the beginning of the compression stroke. As a result, air-filling (air-charge) efficiency is improved and knocking is controlled. It should be noted that alcohol other than methanol can be used as the injected alcohol. Also, mixed liquid of alcohol and water may be used as the injected alcohol.

Sixth Embodiment

A control apparatus for the internal combustion engine according to the sixth embodiment of the present invention will be described. The control apparatus according to the sixth embodiment differs from the first embodiment in that the sixth embodiment injects into the combustion chamber 25, synthetic gas including mainly carbon monoxide and hydrogen which are obtained by partially oxidizing (or reforming) the fuel in a fuel reformer (a fuel reforming device) as high pressure gas instead of the air injected by the first embodiment. Thus, hereinafter, the description is made by focusing on this difference.

Figure 20:
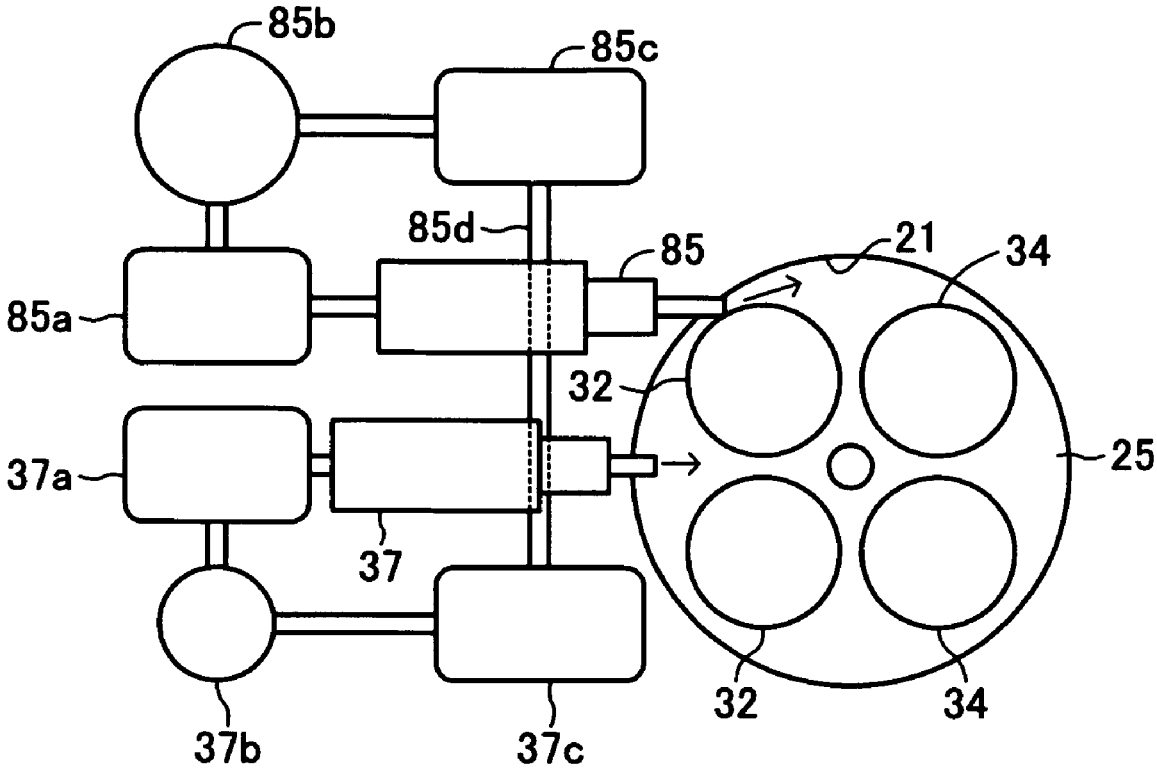
FIG. 20 is a schematic configuration diagram of means for injecting fuel and means for injecting high pressure synthetic gas of the sixth embodiment of the present invention.

This control apparatus, as shown in FIG. 20, comprises a gas injection valve 85 in place of the air injection valve 38. The gas injection valve 85 is communicated with a gas accumulation tank 85*a*, a gas compressor (gas pump) 85*b*, and a fuel reformer 85*c*, in this order.

The fuel reformer 85*c* partially oxidizes (or reforms) the fuel taken out from the fuel tank 37*c* to form synthetic gas (syngas) including mainly carbon monoxide and hydrogen. The gas compressor 85*b* compresses the synthetic gas supplied from the fuel reformer 85*c* in response to a driving signal, and then supplies the gas accumulation tank 85*a* with the compressed synthetic gas. The gas accumulation tank 85*a* accumulates the high pressure (or compressed) synthetic gas. The gas injection valve 85 is exposed to the combustion chamber 25 and is disposed such that it injects the high pressure synthetic gas along the tangential direction of the cylinder bore.

With the arrangements above, the gas injection valve 85 injects the high pressure synthetic gas into the combustion chamber 25 along the tangential direction of the cylinder bore, when opened in response to the driving signal.

An electric control device 70 according to the sixth embodiment operates substantially in the same way as the control device 70 of the first embodiment. However, the table Map θadd(Accp,NE) used in step 1345 shown in FIG. 13 has been adapted to the synthetic gas.

According to the control apparatus for the internal combustion engine of the sixth embodiment, the synthetic gas is injected into the combustion chamber 25 from the gas injection valve 85 during the middle phase of the compression stroke. Thus, the temperature un-uniformity of the air-fuel mixture gas is enhanced at the timing of 20 to 30° crank angle prior to the fuel pyrolysis starting timing at the latest. Further, the temperature un-uniformity formed at the above timing can last till the fuel pyrolysis starting timing.

Furthermore, mixing of the synthetic gas and the air-fuel mixture gas (or fuel) progresses for the time period corresponding to 20 to 30° crank angle from the synthetic gas injection timing. Thus, the air-fuel mixture gas at the fuel pyrolysis starting timing has the temperature un-uniformity which is significant and large in moderating the combustion. Accordingly, the combustion becomes moderated and the combustion period is lengthened. As a result, it is avoided that the pressure rising rate becomes excessive, and therefore, the noise (combustion noise) is reduced.

Moreover, in the sixth embodiment, the swirl flow is generated in the combustion chamber 25, because the high pressure synthetic gas is injected into the combustion chamber 25 along the tangential direction of the cylinder bore. Thus, the heat transfer is enhanced (or is promoted) between the air-fuel mixture gas and the wall of the cylinder 21 whose temperature is lower than the air-fuel mixture gas to increase a heat transfer coefficient of the wall of the cylinder 21. As a result, the temperature un-uniformity of the air-fuel mixture gas is formed more effectively.

Furthermore, hydrogen does not tend to be self-ignited easily (hydrogen is harder to be self-ignited, hydrogen has poor self-ignitability), however, tends to be combusted (burnt) fast once ignited. Meanwhile, carbon monoxide tends to be self-ignited as easily as gasoline (carbon monoxide has the same self-ignitability as gasoline), however, tends to be combusted (burnt) slowly after ignited.

Thus, the mixture gas including the gasoline (or diesel oil) and the synthetic gas requires, because of the existence of hydrogen, longer time to be self-ignited than the mixture gas including the gasoline (or diesel oil) but which does not include the synthetic gas. In addition, the combustion speed of the mixture gas including the gasoline (or diesel oil) and the synthetic gas, because of the existence of carbon monoxide, is lower than that of the mixture gas including the gasoline (or diesel oil) which does not include the synthetic gas. As a result, according to the sixth embodiment, it is possible to lengthen the combustion period more effectively not only by the temperature un-uniformity of the air-fuel mixture gas but also by the un-uniformity of concentration due to existence of the synthetic gas.

Furthermore, in the sixth embodiment, the high pressure synthetic gas is injected into the air-fuel mixture gas in the combustion chamber 25 whose pressure is lower than the injected synthetic gas. Therefore, the temperature of the injected synthetic gas decreases due to the effect of the adiabatic expansion. As a result, it is possible to provide the air-fuel mixture gas with the temperature un-uniformity more effectively.

Meanwhile, a lower temperature portion is formed so as to have a ring-like shape in the vicinity of the bottom wall of the cylinder 21 by such synthetic gas injection so that the un-uniformity of the mixture is obtained. On the other hand, temperature of the air-fuel mixture gas existing in the central area of the combustion chamber 25 does not reduce, and therefore, self-ignitability of the air-fuel mixture gas existing in the central area of the combustion chamber 25 does not change greatly compared to the case where no synthetic gas injection is performed. Accordingly, it is easily accomplished to lengthen the combustion period without varying the self-ignition timing.

Further, in the sixth embodiment, since the partially oxidized gasoline (fuel) is used as the high pressure fluid to form the temperature un-uniformity, neither tanks nor gas container is required except for a tank storing the gasoline (a fuel tank). Thus, the vehicle can be lightened.

Seventh Embodiment

A control apparatus for the internal combustion engine according to the seventh embodiment of the present invention will be described. The control apparatus according to the seventh embodiment differs from the first embodiment in that the seventh embodiment injects fuel supplementarily as the high pressure fluid instead of the air. In other words, the control apparatus forms the air-fuel mixture by injecting, around the bottom dead center (i.e., within a period from the scavenging stroke to the intake stroke before the start of the compression stroke), a large part of the fuel to be injected finally. In addition, the control apparatus injects the rest of the fuel to be injected finally in order to moderate the combustion. Thus, hereinafter, the description is made by focusing on this point.

The control apparatus according to the seventh embodiment comprises components that the first embodiment has, excluding the air injection valve 38, the air accumulation tank 38*a*, the heat exchange unit 38*b*, the air compressor 38*c*, and an air cleaner 38*d*. The CPU 71 of the electric control device 70 executes routines shown in FIGS. 21 and 22 that replace FIGS. 13 and 14, respectively. Note that steps shown in FIGS. 21 and 22 that are the same as the steps already described have the same numerals, and their detailed description are omitted.

Figure 21:
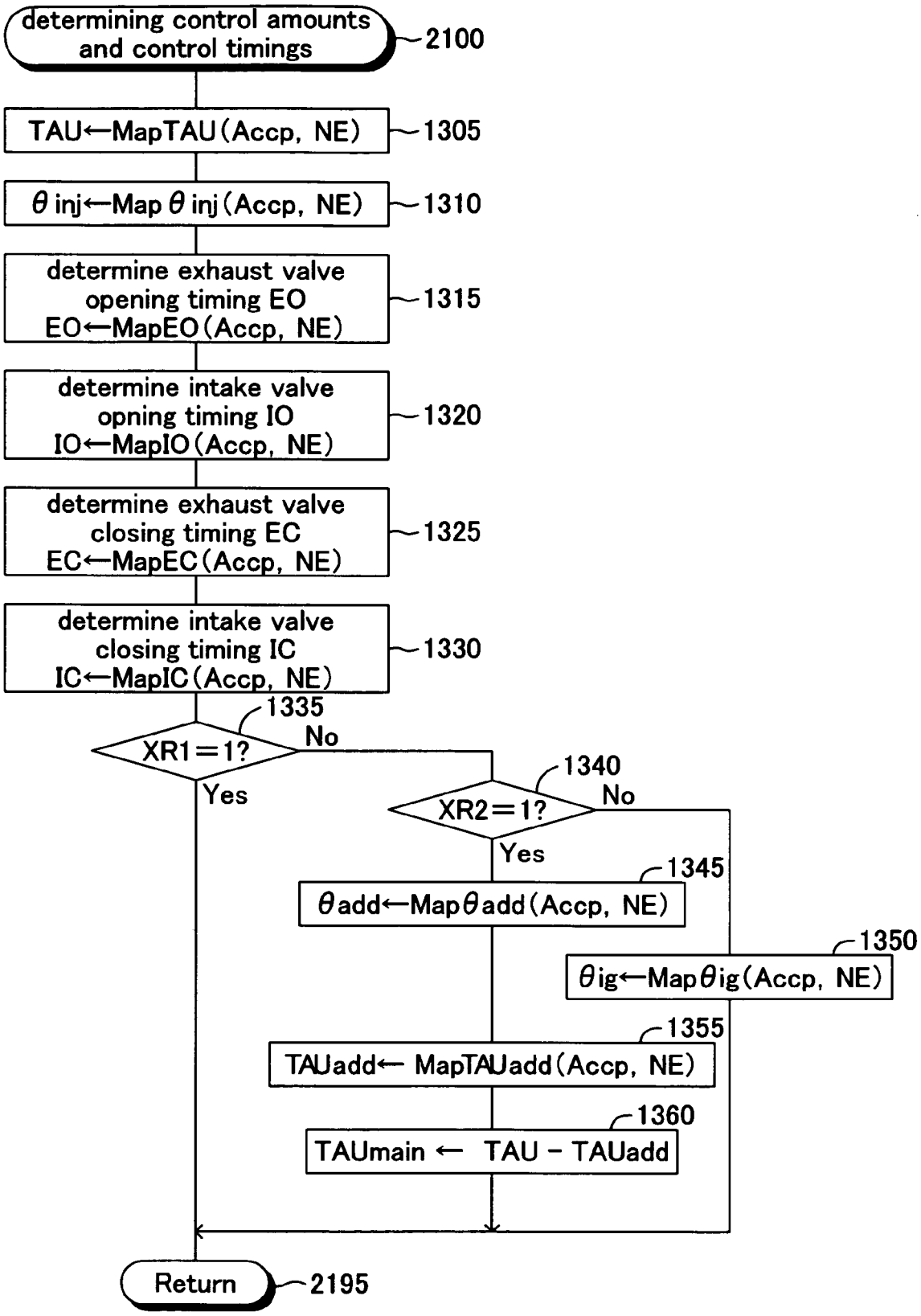
FIG. 21 is a flowchart showing a routine, that the CPU of a control apparatus for an internal combustion engine according to a seventh embodiment of the present invention executes, for determining control amounts and control timings for the engine.

The CPU 71 starts processing from step 2100 shown in FIG. 21 when the crank angle reaches the top dead center, and proceeds to steps 1305 to step 1330 to determines various control amounts and control timings. Subsequently, when the internal combustion engine 10 is operated in the 2-cycle self-ignition area R1, the CPU 71 proceeds to step 2195 directly to end the present routine for the present. On the other hand, when the internal combustion engine 10 is operated in the 2-cycle spark-ignition area R3, the CPU 71 executes processes of step 1335, step 1340, and step 1350 and then ends the present routine for the present. The operations described above are identical to the operations of the first embodiment.

Note that the table Map θinj(Accp,NE) used in step 1310 is set in such a manner that the fuel injection start timing θinj is within the compression stroke (i.e., the injection period is within the compression stroke), when the driving condition of the internal combustion engine 10 is in the 2-cycle self-ignition area R1 which is a light load area (i.e., when the load of the internal combustion engine 10 is smaller than the predetermined middle load threshold).

Also, the table Map θinj(Accp,NE) is set in such a manner that the fuel injection start timing θinj is within the scavenging stroke or the intake stroke (i.e., the injection period from an injection start timing till an injection stop timing is in a period from the scavenging stroke to the intake stroke before the start of the compression stroke, including the scavenging stroke only, the intake stroke only, or a period which partially overlaps both of the scavenging stroke and the intake stroke, when the driving condition of the internal combustion engine 10 is in a area in which the load of the engine is relatively higher within the 2-cycle self-ignition area R1 (i.e., when the load of the internal combustion engine 10 is in a middle load area in which the load of the engine is larger than the middle load threshold and smaller than a predetermined large load threshold larger than the middle load threshold) or when the driving condition of the internal combustion engine 10 is in the 2-cycle self-ignition area R2 (i.e., the load of the internal combustion engine is within a large load area where the load of the engine is larger than the large load threshold).

When the driving condition of the internal combustion engine 10 is in the 2-cycle self-ignition area R2 (i.e., when the load of the internal combustion engine 10 is in a large load area in which the load of the engine is larger than the large load threshold), the CPU 71 forms the "Yes" judgment in step 1340 and proceeds to step 1345 to determine a supplemental fuel injection start timing θadd based on a table Map 0 add (Accp, NE). The CPU 71 then proceeds to step 1355 to determine a supplemental fuel injection amount TAUadd based on a table MapTAUadd(Accp, NE) and proceeds to step 1360 to obtain a main fuel injection amount TAUmain by subtracting the supplemental fuel injection amount TAUadd from the fuel injection amount TAU determined in the prior step 1305. Subsequently, the CPU 71 proceeds to step 2195 to end the present routine for the present.

Figure 22:
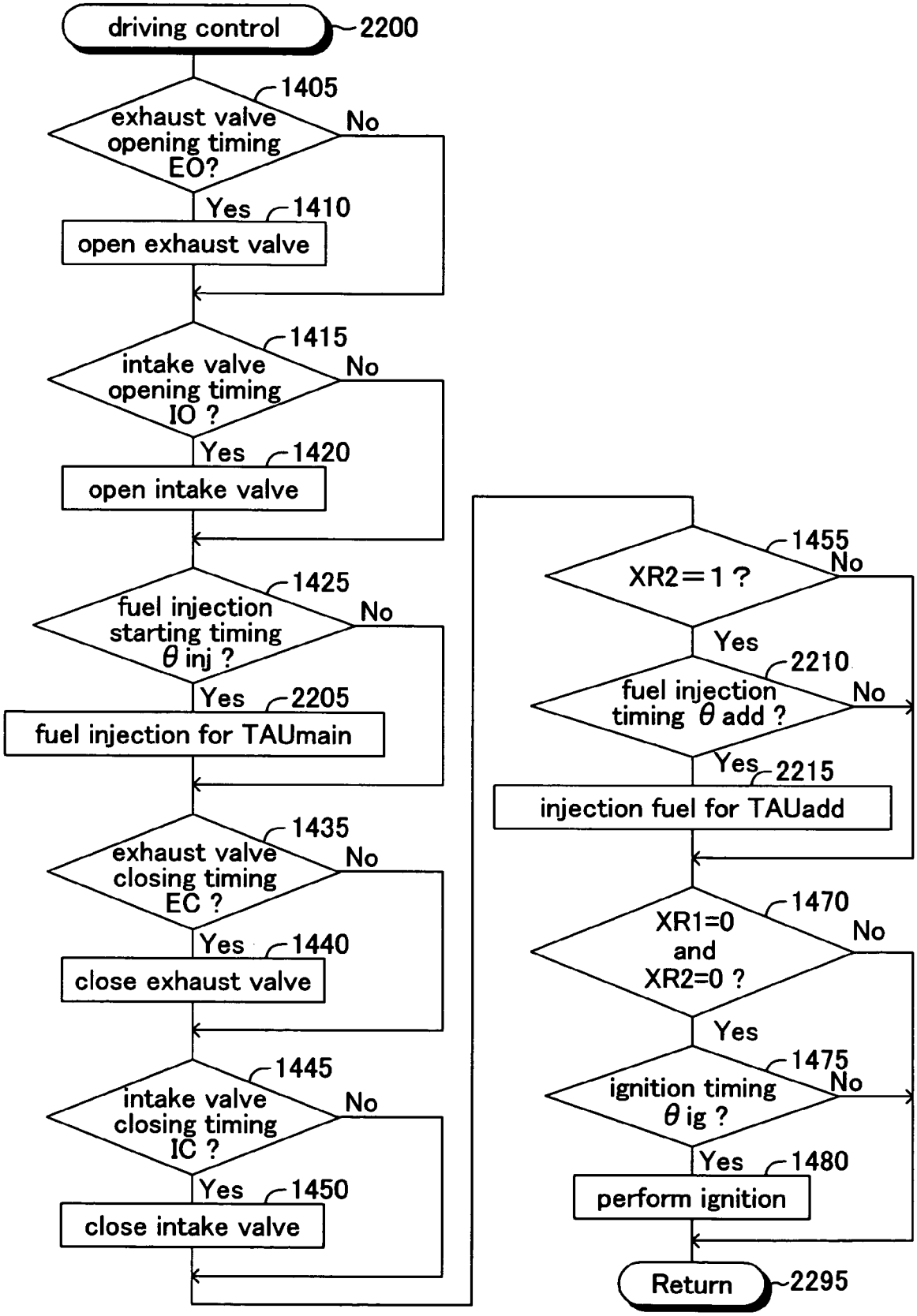
FIG. 22 is a flowchart showing a drive control routine that the CPU of the control apparatus for the internal combustion engine according to a seventh embodiment of the present invention executes.

In the routine shown in FIG. 22, step 1430, step 1460, and step 1465 in the routine shown in FIG. 14 are replaced by step 2205, step 2210, and step 2215, respectively. That is, the CPU 71 repeats the routine shown in FIG. 22 to perform opening and closing control for the exhaust valve 34 and the intake valve 32 and to inject the fuel by the fuel amount corresponding to the fuel injection amount TAUmain at step 2205 when the crank angle reaches the fuel injection timing θinj. Further, the CPU71 executes processing of step 1455, step 2210, and step 2215 to inject the fuel supplementarily by the fuel amount corresponding to the supplemental fuel injection amount TAUadd when the crank angle reaches the supplemental fuel injection timing θadd in the case where the internal combustion engine 10 is operated in the 2-cycle self-ignition area R2.

As described above, according to the control apparatus of the seventh embodiment, the fuel whose amount TAUmain which is a large part of the fuel amount TAU to be injected (TAU being the fuel amount required by the engine) is injected as a main injection at the fuel injection timing θinj which is close to the bottom dead center, and the fuel whose amount TAUadd which is the rest of the fuel amount TAU to be injected is injected supplementarily at the supplemental fuel injection timing θadd which is within the middle phase of the compression stroke.

Thus, the homogeneous air-fuel mixture gas (charge) formed by the main injection of the TAUmain amount is partially cooled by large latent heat and specific heat of the fuel injected supplementarily (injected by the supplemental injection). As a result, the temperature un-uniformity of the air-fuel mixture gas is enhanced at the timing of 20 to 30° crank angle prior to the fuel pyrolysis starting timing at the latest. Further, the temperature un-uniformity formed at the above timing can last till the fuel pyrolysis starting timing.

Thus, the air-fuel mixture gas at the fuel pyrolysis starting timing has the temperature un-uniformity which is significant and large in moderating the combustion. Accordingly, the combustion becomes moderated and the combustion period is lengthened. As a result, it is avoided that the pressure rising rate becomes excessive, and therefore, the noise (combustion noise) is reduced.

Further, by the control apparatus of the seventh embodiment, all of the fuel of the fuel amount TAU required by the engine is injected from the injector 37, during the scavenging stroke, the intake stroke, or a period which partially overlaps both of the scavenging stroke and the intake stroke (i.e., a period before the start of the compression stroke), when the driving condition of the internal combustion engine 10 is within the self-ignition area and in a middle load area where the load of the internal combustion engine is larger than the middle load threshold which is smaller than the large load threshold.

As a result, the homogeneous air-fuel mixture gas is formed when in the middle load area, the stable self-ignition combustion can be accomplished.

Further, when in a small load area where the load of the internal combustion engine is smaller than the middle load threshold, all of the fuel of the fuel amount TAU required by the engine is injected from the injector 37 during the compression stroke.

Therefore, the stable self ignition combustion can be obtained even if the condition of the engine is in the small load area and thereby the required fuel amount is low, because weak stratified air-fuel mixture gas is obtained.

In addition, the temperature un-uniformity is added by injecting fuel supplementarily (i.e., by performing secondary fuel injection) from the existing conventional injector 37, no fluid other than the fuel is required. Also, any injection valves for injecting fluid other than the fuel (or any injectors other than the injector 37) and any pumps for compressing the fluid other the fuel pump 37*b* are not required. Thus, the system can be simplified and lightened, and the cost of the system is lowered.

It should be noted that steps 1305, 1310, 1345, 1355, and 1360 shown in FIG. 21 as well as step 1425, 2205, 2210, and 2215 shown in FIG. 22 constitute fuel injection control means.

As described above, according to the embodiments of the present invention, the air-fuel mixture gas having the enhanced temperature un-uniformity is obtained at fuel pyrolysis starting timing, it is possible to moderate the combustion and therefore to reduce the combustion noise.

It should also be noted that step 1345 shown in FIG. 13 and steps 1460, 1465 shown in FIG. 14, and the high pressure gas injection means (e.g., the air injection means in the first embodiment) constitutes "temperature un-uniformity adding (or providing) means for acting (or affecting) on the air-fuel mixture gas to enhance temperature un-uniformity of the air-fuel mixture gas at a predetermined acting timing within a compression stroke, the predetermined acting timing being prior to fuel pyrolysis starting timing in such a manner that the temperature un-uniformity of the air-fuel mixture gas at the fuel pyrolysis starting timing which is within a compression stroke is made larger than temperature un-uniformity of the air-fuel mixture gas at the fuel pyrolysis starting timing obtained only by simply compressing the air-fuel mixture gas during the compression stroke". Further, step 1345 and step 1355 shown in FIG. 21, step 2210 and 2215 shown in FIG. 22, and the fuel injection means described above constitute the temperature un-uniformity adding means which uses the fuel as the injected high pressure fluid.

Notably, the present invention is not limited to the above-described embodiments, and various modifications may be employed without departing from the scope of the invention. For example, in the embodiments above, the high pressure gas injection start timing θadd (e.g., the air injection start timing θadd in the first embodiment) is set within the middle phase of the compression stroke. However, the high pressure gas injection start timing may be set immediately before the end of the early phase of the compression stroke, and the high pressure gas injection end timing may be set within the middle phase of the compression stroke. That is, a part of the high pressure gas injection period for injecting the gas such as the high pressure air may be at least within the middle phase of the compression stroke. Of course, it is preferable that the both the high pressure gas injection start timing and the high pressure gas injection end timing be within the middle phase of the compression stroke.

Further, the temperature un-uniformity can be considered as a temperature difference between the maximum chamber temperature and the minimum chamber temperature. In this case, the temperature difference may preferably be within 20 to 30 K of standard deviation. In addition, each of the embodiments above is the control apparatus for the 2-cycle internal combustion engine, however, it is apparent that the control apparatus of the present invention can be applied to a 4-cycle internal combustion engine (i.e., a 4-cycle pre-mixed charge compression ignition combustion engine and a 4-cycle spark-ignition combustion engine). Moreover, even when the engine is operated under the self-ignition combustion, the spark-ignition may be supplementarily used to assist the self-ignition.

It should be noted that the control apparatus according to the fifth embodiment may be described as a control apparatus for an internal combustion engine, the internal combustion engine including:

fuel injection means for injecting fuel into a combustion chamber defined by a cylinder and a piston;

spark ignition means exposed to the combustion chamber; and high pressure fluid injection means for injecting high pressure fluid (e.g., high pressure water) into the combustion chamber:

the engine being operated under either one of a pre-mixed charge self-ignition mode and a spark-ignition mode, if a driving condition of the engine is within a self-ignition area, the engine being operated under the pre-mixed charge self-ignition mode in which air-fuel mixture gas including at least air and the fuel injected by the fuel injection means is formed in the combustion chamber prior to the beginning of a compression stroke and the formed air-fuel mixture gas is self-ignited to be combusted by compressing the formed air-fuel mixture during the compression stroke, and if the driving condition of the engine is within a spark-ignition area which is an area other than said self-ignition area, the engine being operated under the spark-ignition mode in which air-fuel mixture gas including at least air and the fuel injected by the fuel injection means is spark-ignited by spark by said spark ignition means to be combusted after the air-fuel mixture gas is compressed during the compression stroke;

the control apparatus comprising:

high pressure fluid injection control means for injecting said high pressure fluid from said high pressure fluid injection means when crank angle reaches a predetermined crank angle (former or first predetermined crank angle), if the operating mode of the engine is said pre-mixed charge self-ignition mode, and for injecting said high pressure fluid from said high pressure fluid injection means when crank angle reaches another predetermined crank angle (latter or second predetermined crank angle) which is different from said predetermined crank angle (former or first predetermined crank angle), if the operating mode of the engine is said spark-ignition mode.

That is, if the operating mode of the engine is said pre-mixed charge self-ignition mode, the high pressure water serving as the high pressure fluid is injected at the water injection starting timing θadd, whereas if the operating mode of the engine is said spark-ignition mode, the high pressure water serving as the high pressure fluid is injected at the water injection starting timing θaddk different from the θadd.

In this case, the high pressure fluid is not limited to the water of the fifth embodiment, but may be any one of air, hydrogen, carbon monoxide, combustion gas which is compressed combustion gas after emitted from the combustion chamber, water, liquid fuel including alcohol, synthetic gas including carbon monoxide and hydrogen which are obtained by partially oxidizing the fuel, and said fuel (injected from the fuel injection means).

By this feature, under the pre-mixed charge self-ignition mode, the high pressure fluid is injected at a crank angle which is different form a crank angle at which the high pressure fluid is injected under the spark-ignition mode. For instance, when the engine is operated under pre-mixed charge self-ignition mode, the high pressure fluid is injected at a predetermined timing within the compression stroke prior to the fuel pyrolysis starting timing of the fuel included in the air-fuel mixture gas. This enables the air-fuel mixture gas to have the enhanced temperature un-uniformity at the starting timing of the substantial combustion, and thus, the combustion becomes moderated and the combustion period is lengthened. As a result, under the pre-mixed charge self-ignition mode, it is avoided that the pressure rising rate in the combustion chamber becomes excessive, and thus, the combustion noise is reduced.

Furthermore, for instance, when the engine is operated under spark-ignition mode, the high pressure fluid is injected at another predetermined timing prior to the compression stroke. This causes the entire air-fuel mixture gas to be cooled. As a result, air-filling (air-charge) efficiency is improved and knocking is controlled when the engine is operated by the spark-ignition combustion.

As described above, by the control apparatus configured as above, the high pressure fluid injection means is effectively utilized to inject the high pressure fluid at appropriate timings suitable for the engine operating modes. Thus, it is possible to improve the fuel efficiency and/or to reduce the noise.

In this case, as described with respect to the fifth embodiment, it is preferable that the high pressure fluid injection control means be configured so as to inject the high pressure fluid only when a load of the internal combustion engine is larger than a first predetermined high load threshold if the operating mode of the engine is said pre-mixed charge self-ignition mode.

By this feature, the high pressure fluid is injected only when the engine is accelerated in which the combustion noise becomes large or a phenomenon similar to engine knocking tends to occur, and so on. Thus, it is possible to reduce an amount of the fluid to be used or to decrease an amount of energy to compress the fluid, while suppressing the combustion noise.

Furthermore, in this case, it is preferable that the high pressure fluid injection control means be configured so as to inject the high pressure fluid only when a load of the internal combustion engine is larger than a second predetermined high load threshold if the operating mode of the engine is said spark-ignition mode.

By this feature, the high pressure fluid is injected only when the load is high in which the air-filling efficiency needs to be increased and the knocking tends to occur. Thus, an amount of the consumption of the fluid can be reduced.

What is claimed is:

1. A control apparatus for an internal combustion engine, the internal combustion engine capable of a pre-mixed charge compression ignition combustion and having fuel injection means for injecting fuel into a combustion chamber defined by a cylinder and a piston, wherein air-fuel mixture gas including at least air and fuel injected by the fuel injection means is formed in the combustion chamber and the air-fuel mixture gas is self-ignited to be combusted by compressing the air-fuel mixture gas during a compression stroke, when a driving condition of the engine is within a self-ignition area, comprising:

temperature un-uniformity adding means for acting on the air-fuel mixture gas to enhance temperature un-uniformity of the air-fuel mixture gas at a predetermined acting timing which is within a middle phase of the compression stroke and prior to fuel pyrolysis starting timing, if the compression stroke is divided into an early phase of the compression stroke, the middle phase of the compression stroke, and a late phase of the compression stroke, the early phase of the compression stroke being a period in which mixing of the air-fuel mixture gas proceeds rapidly due to a turbulent flow in the combustion chamber, the middle phase of the compression stroke being a period in which the mixing of the air-fuel mixture gas proceeds relatively moderately and a the combustion reaction becomes more active gradually, and the late phase of the compression stroke being a period in which an explosive combustion reaction occurs, in such a manner that the temperature un-uniformity of the air-fuel mixture gas at the fuel pyrolysis starting timing which is within a compression stroke is made greater than temperature un-uniformity of the air-fuel mixture gas at the fuel pyrolysis starting timing obtained only by simply compressing the air-fuel mixture gas during the compression stroke, and so that the combustion is more moderate than combustion which occurs only by simply compressing the air-fuel mixture gas during the compression stroke.

2. The control apparatus according to claim 1, wherein said temperature un-uniformity adding means is configured so as to inject high pressure fluid into the air-fuel mixture gas at said predetermined acting timing to enhance the temperature un-uniformity of the air-fuel mixture gas.

3. The control apparatus according to claim 2, wherein said temperature un-uniformity adding means is configured so as to inject said high pressure fluid only when a driving condition of the internal combustion engine is within the self-ignition area and a load of the internal combustion engine is larger than a predetermined high load threshold.

4. The control apparatus according to claim 2, wherein said predetermined acting timing at which said temperature un-uniformity adding means injects said high pressure fluid is set in said middle phase of the compression stroke which is a period from a timing at which the temperature un-uniformity of the air-fuel mixture gas becomes minimum to a timing which precedes a predetermined crank angle prior to said fuel pyrolysis starting timing.

5. The control apparatus according to claim 2, wherein said temperature un-uniformity adding means injects said high pressure fluid along a tangential direction of a bore of said cylinder.

6. The control apparatus according to claim 2, wherein said high pressure fluid is high pressure air.

7. The control apparatus according to claim 2, wherein said high pressure fluid is high pressure hydrogen or high pressure carbon monoxide.

8. The control apparatus according to claim 2, wherein said high pressure fluid is high pressure combustion gas which is compressed combustion gas after emitted from the combustion chamber.

9. The control apparatus according to claim 2, wherein said high pressure fluid is high pressure water.

10. A control apparatus for an internal combustion engine, the internal combustion engine including:

fuel injection means for injecting fuel into a combustion chamber defined by a cylinder and a piston;

spark ignition means exposed to the combustion chamber; and high pressure water injection means for injecting high pressure water into the combustion chamber;

the engine being a 2-cycle engine that repeats an expansion stroke, an exhaust stroke, a scavenging stroke, an intake stroke, and a compression stroke every 360° crank angle, and being operated under either one of a pre-mixed charge self-ignition mode and a spark-ignition mode, wherein the engine is operated under the pre-mixed charge self-ignition mode if a driving condition of the engine is within a self-ignition area, in which air-fuel mixture gas including at least air and the fuel injected by the fuel injection means is formed in the combustion chamber prior to the beginning of the compression stroke and the formed air-fuel mixture gas is self-ignited to be combusted by being compressed during the compression stroke and, wherein the engine is operated under the spark-ignition mode if the driving condition of the engine is within a spark-ignition area which is an area other than said self-ignition area, in which air-fuel mixture gas including at least air and the fuel injected by the fuel injection means is spark-ignited by spark by said spark ignition means to be combusted after the air-fuel mixture gas is compressed during the compression stroke;

the control apparatus comprising:

high pressure water injection control means for injecting said high pressure water from said high pressure water injection means at a predetermined acting timing within a compression stroke prior to a fuel pyrolysis starting timing, if the operating mode of the engine is said pre-mixed charge self-ignition mode, and for injecting said high pressure water from said high pressure water injection means during one of periods of the scavenging stroke, the intake stroke, and a period which partially overlaps both of the scavenging stroke and the intake stroke, if the operating mode of the engine is said spark-ignition mode.

11. The control apparatus according to claim 10, wherein said high pressure water injection control means is configured so as to inject the high pressure water only when a load of the internal combustion engine is higher than a predetermined high load threshold if the operating mode of the engine is said pre-mixed charge self-ignition mode.

12. The control apparatus according to claim 10, wherein said high pressure water injection control means is configured so as to inject the high pressure water only when a load of the internal combustion engine is higher than a second predetermined high load threshold if the operating mode of the engine is said spark-ignition mode.

13. The control apparatus according to claim 2, wherein said high pressure fluid is high pressure liquid fuel including alcohol which is harder to be self-ignited than the fuel.

14. A control apparatus for an internal combustion engine, the internal combustion engine including:

fuel injection means for injecting fuel into a combustion chamber defined by a cylinder and a piston;

spark ignition means exposed to the combustion chamber; and high pressure liquid fuel injection means for injecting into the combustion chamber high pressure liquid fuel including alcohol which is harder to be self-ignited than the fuel;

the engine being a 2-cycle engine which repeats an expansion stroke, an exhaust stroke, a scavenging stroke, an intake stroke, and a compression stroke every 360° crank angle, and being operated under either one of a pre-mixed charge self-ignition mode and a spark-ignition mode, wherein the engine is operated under the pre-mixed charge self-ignition mode if a driving condition of the engine is within a self-ignition area, in which area fuel mixture gas including at least air and the fuel injected by the fuel injection means is formed in the combustion chamber prior to the beginning of the compression stroke and the formed air-fuel mixture gas is self-ignited to be combusted by being compressed during the compression stroke, and wherein the engine is operated under the spark-ignition mode if the driving condition of the engine is within a spark-ignition area which is an area other than said self-ignition area, in which air-fuel mixture gas including at least air and fuel injected by the fuel injection means is spark-ignited by spark by said spark ignition means to be combusted after the air-fuel mixture gas is compressed during the compression stroke;

the control apparatus comprising:

high pressure liquid fuel injection control means for injecting said high pressure liquid fuel from said high pressure liquid fuel injection means at a predetermined acting timing within a compression stroke prior to a fuel pyrolysis starting timing, if the operating mode of the engine is said pre-mixed charge self-ignition mode, and for injecting said high pressure liquid fuel from said high pressure liquid fuel injection means during one of periods of the scavenging stroke, the intake stroke, and a period which partially overlaps both of the scavenging stroke and the intake stroke, if the operating mode of the engine is said spark-ignition mode.

15. The control apparatus according to claim 14, wherein said high pressure liquid fuel injection control means is configured so as to inject the high pressure liquid fuel only when a load of the internal combustion engine is larger than a first predetermined high load threshold if the operating mode of the engine is said pre-mixed charge self-ignition mode.

16. The control apparatus according to claim 1, wherein said high pressure liquid fuel injection control means is configured so as to inject the high pressure liquid fuel only when a load of the internal combustion engine is higher than a second predetermined high load threshold if the opening mode of the engine is said spark-ignition mode.

17. The control apparatus according to claim 2, wherein said high pressure fluid is synthetic gas including carbon monoxide and hydrogen which are obtained by partially oxidizing the fuel.

18. The control apparatus according to claim 2, wherein said temperature un-uniformity adding means is configured so as to inject said fuel as said high pressure fluid from said fuel injection means.

19. A control apparatus for an internal combustion engine, the internal combustion engine including:

fuel injection means for injecting fuel into a combustion chamber defined by a cylinder and a piston;

spark ignition means exposed to the combustion chamber; and high pressure fluid injection means for injecting high pressure fluid into the combustion chamber;

the engine being operated under either one of a pre-mixed charge self-ignition mode and a spark-ignition mode, if a driving condition of the engine is within a self-ignition area, the engine being operated under the pre-mixed charge self-ignition mode in which air-fuel mixture gas including at least air and the fuel injected by the fuel injection means is formed in the combustion chamber prior to the beginning of a compression stroke and the formed air-fuel mixture gas is self-ignited to be combusted, and if the driving condition of the engine is within a spark-ignition area which is an area other than said self-ignition area, the engine being operated under the spark-ignition mode in which air-fuel mixture gas including at least air and the fuel injected by the fuel injection means is spark-ignited by spark by said spark ignition means to be combusted after the air-fuel mixture gas is compressed during the compression stroke;

the control apparatus comprising:

high pressure fluid injection control means for injecting said high pressure fluid from said high pressure fluid injection means when crank angle reaches a predetermined crank angle, if the operating mode of the engine is said pre-mixed charge self-ignition mode, and for injecting said high pressure fluid from said high pressure fluid injection means when crank angle reaches another predetermined crank angie different from said predetermined crank angle, if the operating mode of the engine is said spark-ignition mode.

20. The control apparatus according to claim 19, wherein said high pressure fluid injection control means is configured so as to inject the high pressure fluid only when a load of the internal combustion engine is larger than a first predetermined high load threshold if the operating mode of the engine is said pre-mixed charge self-ignition mode.

21. The control apparatus according to claim 19, wherein said high pressure fluid injection control means is configured so as to inject the high pressure fluid only when a load of the internal combustion engine is larger than a second predetermined high load threshold if the operating mode of the engine is said spark-ignition mode.

22. The control apparatus according to claim 19, wherein said high pressure fluid is a fluid including any one of air, hydrogen, carbon monoxide, combustion gas which is compressed combustion gas after emitted from the combustion chamber, water, liquid fuel including alcohol, synthetic gas including carbon monoxide and hydrogen which are obtained by partially oxidizing the fuel, and said fuel.

23. A control apparatus for an internal combustion engine, the internal combustion engine capable of a pre-mixed charge compression ignition combustion and having a fuel injection means for injecting fuel into a combustion chamber defined by a cylinder and a piston, wherein air-fuel mixture gas including at least air and fuel injected by the fuel injection means is formed in the combustion chamber prior to beginning of a compression stroke and the air-fuel mixture gas is self-ignited to be combusted by compressing the air-fuel mixture gas during the compression stroke, when a driving condition of the engine is within a self-ignition area;

the control apparatus comprising:

fuel injection control means for injecting from said fuel injection means a part of fuel of an fuel amount required by the engine prior to the beginning of the compression stroke and injecting from said fuel injection means the rest of the fuel of the amount required by the engine at a predetermined timing within the compression stroke prior to a fuel pyrolysis starting timing of said injected fuel, if a load of the engine is in a high load area where the load is higher than a high load threshold, for injecting from said fuel injection means all of fuel of the fuel amount required by the engine prior to the compression stroke, if the load of the engine is in a middle load area where the load is higher than a middle load threshold which is lower than said high load threshold, and for injecting from said fuel injection means all of fuel of the fuel amount required by the engine during the compression stroke, if the load of the engine is in a low load area where the load is lower than said middle load threshold.

24. A control apparatus for an internal combustion engine having fuel injection means for injecting fuel into a combustion chamber defined by a cylinder and a piston, the engine being a 2-cycle engine that repeats an expansion stroke, an exhaust stroke, a scavenging stroke, an intake stroke, and a compression stroke every 360° crank angle, wherein air-fuel mixture gas including at least air and fuel injected by the fuel injection means is formed in the combustion chamber prior to beginning of the compression stroke, and the air-fuel mixture gas is self-ignited to be combusted by compressing the air-fuel mixture gas during the compression stroke, when a driving condition of the engine is within a self-ignition area, comprising:

fuel injection control means for injecting from said fuel injection means a part of fuel of an fuel amount required by the engine during one of periods of the scavenging stroke, the intake stroke, and a period which partially overlaps both of the scavenging stroke and the intake stroke, and injecting from said fuel injection means the rest of the fuel of the amount required by the engine at a predetermined timing within the compression stroke prior to a fuel pyrolysis starting timing of said injected fuel, if a load of the engine is in a high load area where the load is higher than a high load threshold, for injecting from said fuel injection means all of fuel of the fuel amount required by the engine during one of periods of the scavenging stroke, the intake stroke, and a period which partially overlaps both of the scavenging stroke and the intake stroke, if the load of the engine is in a middle load area where the load is higher than a middle load threshold which is lower than said high load threshold, and for injecting from said fuel injection means all of fuel of the fuel amount required by the engine during the compression stroke, if the load of the engine is in a low load area where the load is lower than said middle load threshold.

25. The control apparatus according to claim 1, wherein said temperature un-uniformity adding means changes said predetermined acting timing based on a load of the engine and a engine rotational speed.

* * * * *